US011065666B2

(12) United States Patent
Ito

(10) Patent No.: US 11,065,666 B2
(45) Date of Patent: Jul. 20, 2021

(54) BURRING METHOD AND BURRING DEVICE

(71) Applicant: NIPPON STEEL & SUMITOMO METAL CORPORATION, Tokyo (JP)

(72) Inventor: Yasuhiro Ito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 555 days.

(21) Appl. No.: 16/071,424

(22) PCT Filed: Jan. 20, 2017

(86) PCT No.: PCT/JP2017/002027
§ 371 (c)(1),
(2) Date: Jul. 19, 2018

(87) PCT Pub. No.: WO2017/126696
PCT Pub. Date: Jul. 27, 2017

(65) Prior Publication Data

US 2020/0230683 A1 Jul. 23, 2020

(30) Foreign Application Priority Data

Jan. 21, 2016 (JP) ..... JP2016-009531

(51) Int. Cl.
*B21D 28/26* (2006.01)
*B21D 19/08* (2006.01)

(52) U.S. Cl.
CPC ..... *B21D 28/26* (2013.01); *B21D 19/08* (2013.01); *B21D 19/088* (2013.01)

(58) Field of Classification Search
CPC ..... B21D 19/08; B21D 19/088; B21D 22/20; B21D 22/22; B21D 28/02; B21D 28/14
(Continued)

(56) References Cited

U.S. PATENT DOCUMENTS 9,328,824 B2 * 5/2016 Maki ..... B21D 22/24
2012/0073350 A1 * 3/2012 Iwata ..... B21D 22/24 72/347

FOREIGN PATENT DOCUMENTS

JP 50-20387 A 3/1975
JP 62-183916 A 8/1987
(Continued)

OTHER PUBLICATIONS

Nakamura, Translation of JP-S62183916-A (Year: 1987).*
(Continued)

*Primary Examiner* — Adam J Eiseman
*Assistant Examiner* — Bobby Yeonjin Kim
(74) *Attorney, Agent, or Firm* — Birch, Stewart, Kolasch & Birch, LLP

(57) ABSTRACT

A burring method includes: a placement process of disposing a sheet-shaped workpiece formed with a through hole such that a punch is positioned on one sheet thickness direction side of the workpiece and a pad is positioned on the opposite side to the one sheet thickness direction side of the workpiece; and an extrusion process of forming a flange by moving the punch toward the opposite side relative to the workpiece and extruding a peripheral rim of the through hole in the workpiece with the punch in a state in which the peripheral rim of the through hole is pressed by the punch and the pad in the sheet thickness direction of the workpiece.

2 Claims, 16 Drawing Sheets

(58) Field of Classification Search
USPC ..... 72/325, 326, 327, 332, 333
See application file for complete search history.

(56) References Cited

FOREIGN PATENT DOCUMENTS

| | | | | | |
|---|---|---|---|---|---|
| JP | S62183916 | A | * | 8/1987 | ..... B21D 19/08 |
| JP | 9-1251 | A | | 1/1997 | |
| JP | 2014-172089 | A | | 9/2014 | |

OTHER PUBLICATIONS

International Preliminary Report on Patentability, dated Jul. 24, 2018 and English translation of Written Opinion of the International Searching Authority, issued in PCT/JP2017/002027 (Forms PCT/IB/373 and PCT/ISA/237),
International Search Report for PCT/JP2017/002027 (PCT/ISA/210) dated Mar. 21, 2017.
Written Opinion of the International Searching Authority for PCT/JP2017/002027 (PCT/ISA/237) dated Mar. 21, 2017.
Extended European Search Report for corresponding European Application No. 17741573.4, dated Jan. 23, 2019.

* cited by examiner

BURRING METHOD AND BURRING DEVICE

TECHNICAL FIELD

The present disclosure relates to a burring method and a burring device.

BACKGROUND ART

In burring methods for forming a tubular flange in a workpiece configured by, for example, a metal stock sheet formed with a pilot hole (through hole), a flange is generally formed by using a punch to extrude a peripheral rim of the pilot hole in the metal stock sheet. In Japanese Patent Application Laid-Open (JP-A) No. 2014-172089, for example, a high strength steel sheet with low ductility is suppressed from cracking at a flange leading end portion (at a peripheral rim of a pilot hole) by forming a leading end portion of the punch in a substantially circular conical shape. Another burring method is described in JP-A No. H06-087039.

SUMMARY OF INVENTION

Technical Problem

In JP-A No. 2014-172089, it is necessary to set the leading end portion of the punch with a profile appropriate for the pilot hole in the metal stock sheet, and the punch has a complicated profile. A burring method capable of suppressing cracking of a flange leading end portion with a simple configuration is thus desirable.

In consideration of the above circumstances, an object of the present disclosure is to provide a burring method and a burring device capable of suppressing cracking of a flange leading end portion with a simple configuration.

Solution to Problem

A burring method of a first aspect of the present disclosure includes: a placement process of disposing a sheet-shaped workpiece formed with a through hole such that a punch is positioned on one sheet thickness direction side of the workpiece and a pad is positioned on the opposite side to the one sheet thickness direction side of the workpiece; and an extrusion process of forming a flange by moving the punch toward the opposite side relative to the workpiece and extruding a peripheral rim of the through hole in the workpiece with the punch in a state in which the peripheral rim of the through hole is pressed by the punch and the pad in the sheet thickness direction of the workpiece.

A burring device of another aspect of the present disclosure includes: a punch that is disposed on one sheet thickness direction side of a sheet-shaped workpiece formed with a through hole, and that is moved relative to the workpiece toward the opposite side to the one sheet thickness direction side of the workpiece so as to extrude a peripheral rim of the through hole in the workpiece to form a flange; and a pad that is disposed opposing the punch on the opposite side to the one sheet thickness direction of the workpiece, and that, together with the punch, presses the peripheral rim of the through hole in the workpiece during extrusion of the workpiece by the punch.

A burring device of yet another aspect of the present disclosure includes: a punch that includes a flat top face at least at a periphery of the punch, and that includes a top face-side portion with a circular columnar shape; a holder that is disposed surrounding the punch; a die that is disposed opposing the holder, and that includes a housing portion open toward the punch side; and a pad that is disposed inside the housing portion, that is capable of moving in a pressing direction, and that includes an opposing face opposing the top face of the punch.

Advantageous Effects of Invention

The present disclosure is capable of providing a burring method and a burring device capable of suppressing cracking of a flange leading end portion with a simple configuration.

DESCRIPTION OF EMBODIMENTS

First Exemplary Embodiment

Explanation follows regarding a burring method according to a first exemplary embodiment, with reference to FIG.

Figure 5:
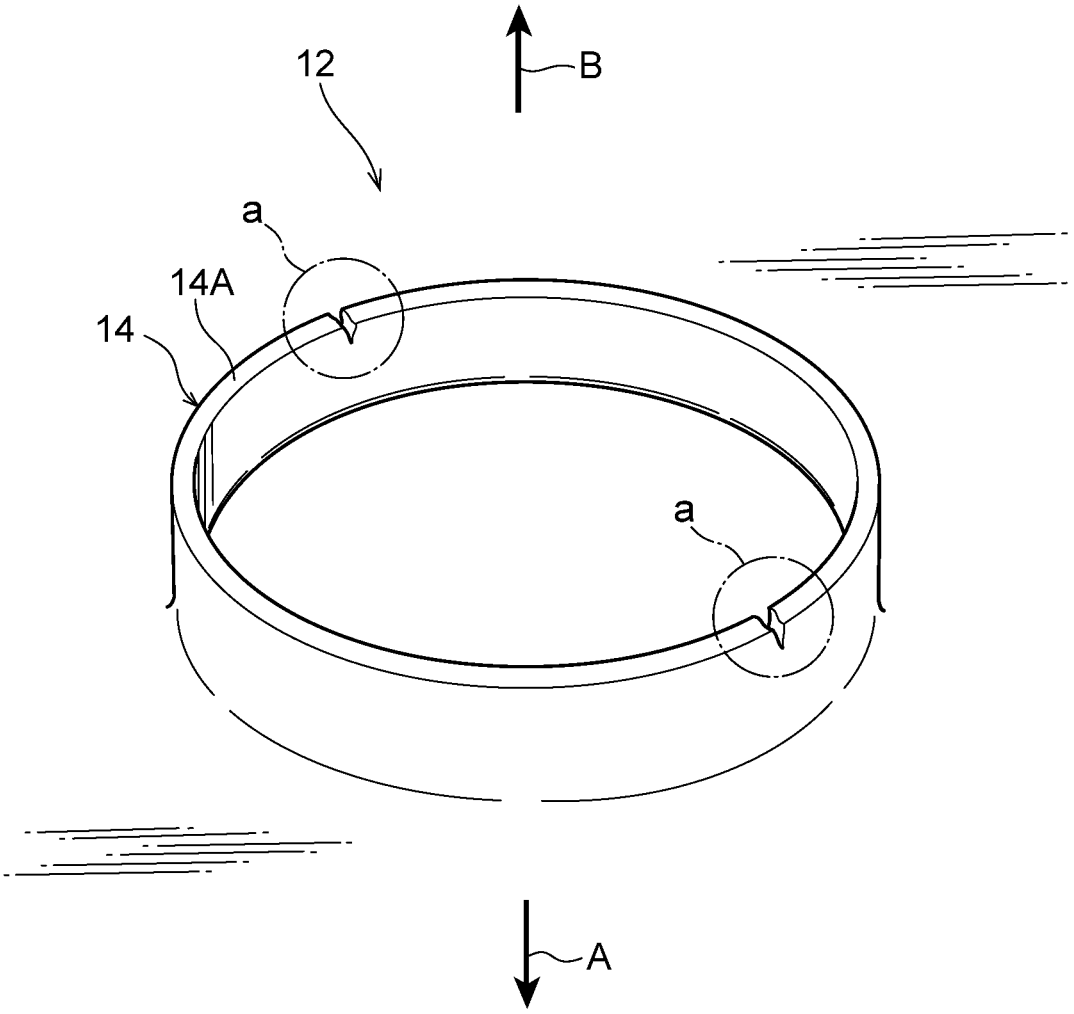
FIG. 5 is a perspective view illustrating a state in which cracking has occurred at a leading end portion of a flange burred using the burring method of the comparative example.

1 to FIG. 5. In this burring method, burring is performed on a metal stock sheet 10, serving as a "workpiece" that is formed with a pilot hole, to manufacture a burred article 12 with a substantially cylindrical flange 14. Note that the "pilot hole" refers to a through hole penetrating the metal stock sheet 10 in its sheet thickness direction. First, explanation follows regarding configuration of the metal stock sheet 10 and configuration of the burred article 12. Explanation will then be given regarding a burring device 20 employed for burring. This will be followed by explanation regarding the burring method. Note that in the drawings, equivalent members and the like are allocated the same reference numerals, and explanation will be omitted as appropriate in the case of members equivalent to those already described.

Metal Stock Sheet 10 and Burred Article 12

Figure 3:
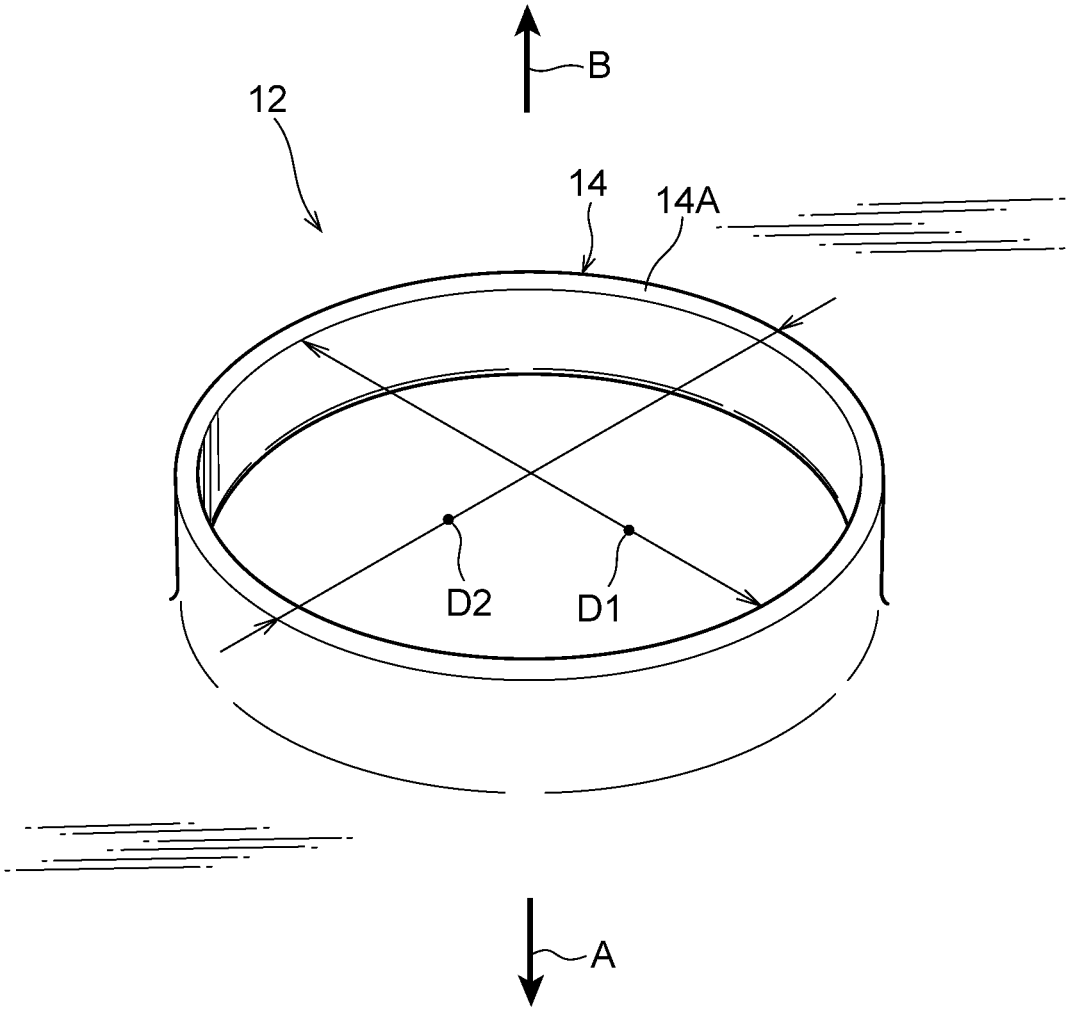
FIG. 3 is a perspective view illustrating a burred article that has been burred by the burring device illustrated in FIG. 1.

Explanation follows regarding the burred article 12, with reference to FIG. 3. In FIG. 3, arrow A points toward one sheet thickness direction side of the burred article 12, and arrow B points toward the opposite side to the one sheet thickness direction side of the burred article 12, namely toward another sheet thickness direction side of the burred article 12.

Figure 1:
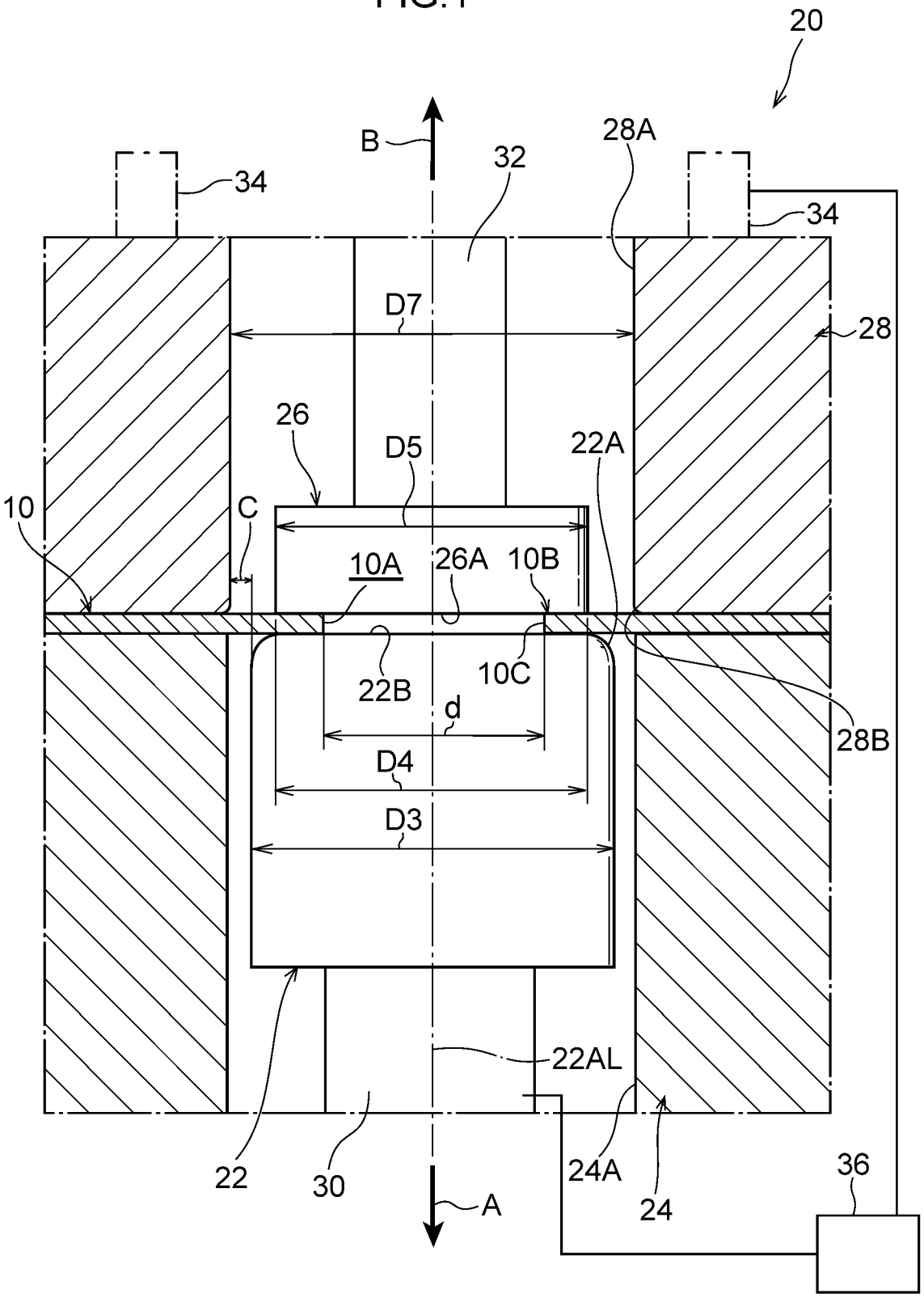
FIG. 1 is a cross-section illustrating relevant portions of a burring device employed in a burring method according to a first exemplary embodiment.

The burred article 12 is, for example, configured by a high strength steel sheet with a tensile strength of 440 MPa or greater. As an example, in the present exemplary embodiment, the high strength steel sheet configuring the burred article 12 has a tensile strength of 590 MPa and a sheet thickness of 2.9 mm. The burred article 12 is burred in order to form the flange 14 projecting toward the other sheet thickness direction side. An internal diameter D1 of the flange 14 is, for example, 60 mm. As illustrated in FIG. 1, prior to burring, the metal stock sheet 10 is formed with a circular pilot hole 10A that is used to form the flange 14. The internal diameter d of the circular pilot hole 10A is, for example, 36 mm. Namely, the burring method and burring device of the present exemplary embodiment shape the flange 14 by enlarging the hole by a hole enlargement factor ((D1−d)/d) of 0.67. Note that there is no limitation to a circular pilot hole 10A, and the pilot hole 10A may, for example, be elliptical.

Burring Device 20

Explanation follows regarding the burring device 20, with reference to FIG. 1. Note that in FIG. 1, arrow A points toward the device lower side of the burring device 20, and arrow B points toward the device upper side of the burring device 20. The device up-down direction corresponds to the sheet thickness direction of the metal stock sheet 10. Note that the upper side and the lower side in the drawings are defined within the purposes of this explanation, and the up-down direction in the drawings need not correspond to a vertical direction.

The burring device 20 is configured including a punch 22 and a holder 24 configuring a device lower side section of the burring device 20, and a pad 26 and a die 28 configuring a device upper side section of the burring device 20. The metal stock sheet 10 is disposed between the punch 22 and the holder 24 on one side, and the pad 26 and the die 28 on the other side, when applying a burr to the metal stock sheet 10.

Figure 11:
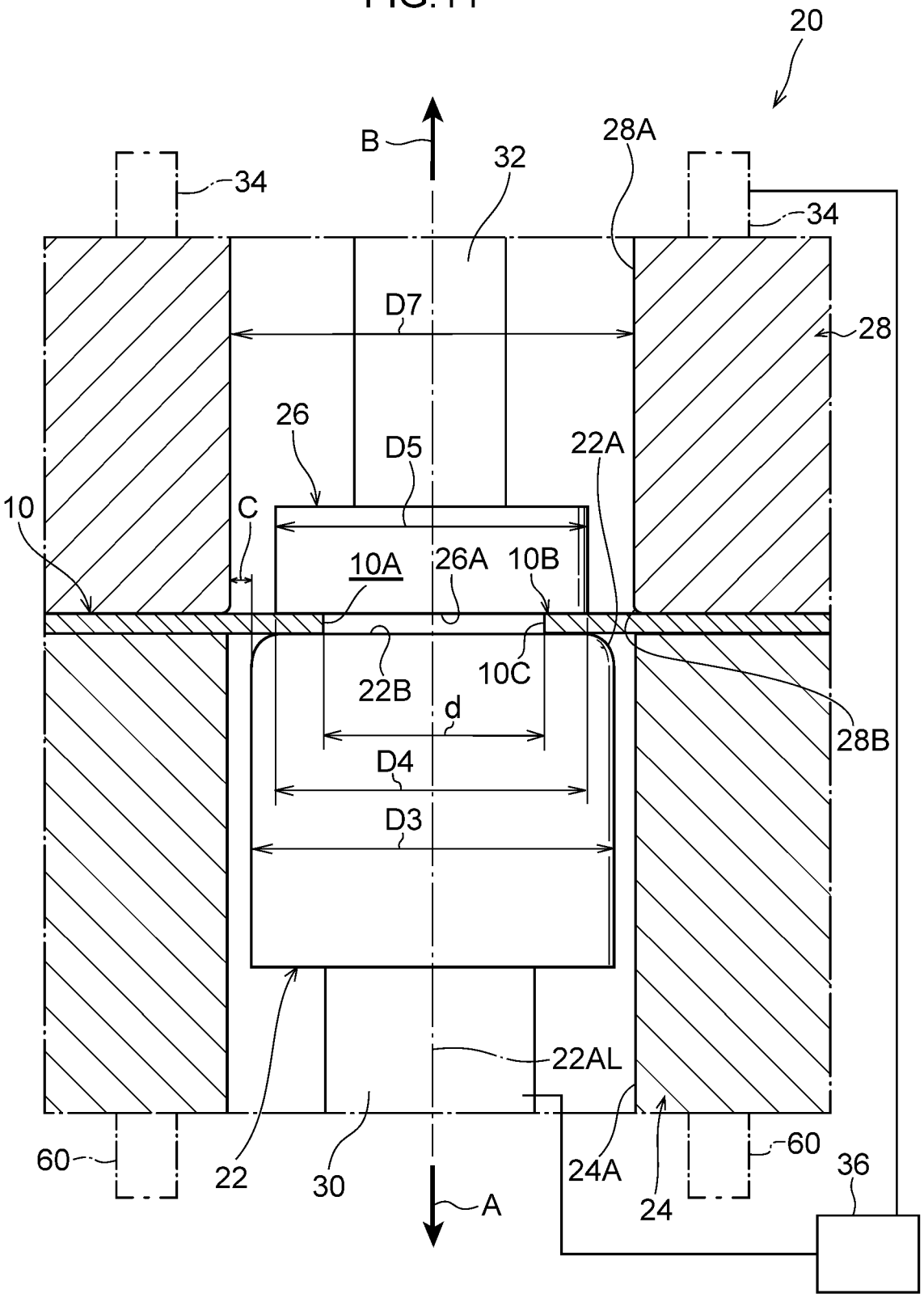
FIG. 11 is a cross-section illustrating relevant portions of a modified example of a burring device employed in the burring method according to the first exemplary embodiment.

An upper face of the holder 24 configures a placement face on which the metal stock sheet 10 is placed. Configuration is made such that the metal stock sheet 10 is positioned with respect to the holder 24 when the metal stock sheet 10 is placed on the upper face of the holder 24. Examples of this configuration include a positioning pin (not illustrated in the drawings) provided at the upper face of the holder 24, and a positioning hole (not illustrated in the drawings), into which the pin is inserted, formed in the metal stock sheet 10. The upper face of the holder 24 is formed with a punch housing portion 24A in which the punch 22 is housed at a position corresponding to the pilot hole 10A in the metal stock sheet 10. The punch housing portion 24A is formed as a recess opening toward the device upper side. In other words, the holder 24 includes the punch housing portion 24A that opens toward the device upper side. The punch housing portion 24A is formed in a circular shape as viewed from the device upper side. A lower end portion of the holder 24 may be coupled to holder pressing devices 60, as in a modified example of the burring device 20 illustrated in FIG. 11. The holder pressing devices 60 may, for example, be configured by gas cushions, hydraulic devices, springs, or electrically powered devices.

The punch 22 is formed in a substantially column shape with its axial direction running in the device up-down direction (in a direction along an axial line 22AL, described later). Note that in FIG. 1, the axial line 22AL of the punch 22 is illustrated by a dot-dash line. A pressing direction of the burring device 20 is a direction running along the axial line 22AL of the punch.

The punch 22 is housed inside the punch housing portion 24A. An external diameter D3 of the punch 22 is the same dimension as the internal diameter D1 of the flange 14 of the burred article 12. Namely, in the present exemplary embodiment, the external diameter D3 of the punch 22 is 60 mm. A mover device 30, serving as an example of a punch mover device, is coupled to a lower end portion of the punch 22. The mover device 30 enables the punch 22 to move in the device up-down direction relative to the holder 24. Specifically, the mover device 30 enables the punch 22 to move along its axial direction. The mover device 30 is, for example, configured by a hydraulic cylinder.

Note that the pilot hole 10A in the metal stock sheet 10 is disposed coaxially to the punch 22 in a state in which the metal stock sheet 10 has been placed on the holder 24.

Note that the exemplary embodiment described above is one example, and the pilot hole 10A need not be disposed coaxially to the punch 22. However, it is desirable for the center of gravity of the pilot hole 10A to overlap with the axis of the punch 22 in order to achieve uniform burring of a peripheral rim 10B of the pilot hole 10A.

A top face of the punch 22 (a face that opposes the pad 26, and not including a shoulder 22A, described later) configures a punch face 22B. The punch face 22B is formed in a plane orthogonal to the device up-down direction. During burring, the punch face 22B is parallel to a lower face (a face on the one sheet thickness direction side) of the metal stock sheet 10 placed on the holder 24. Accordingly, in a state in which the punch face 22B of the punch 22 has been disposed in the same plane as the lower face of the metal stock sheet 10 by the mover device 30, the punch face 22B abuts the lower face of the metal stock sheet 10 in a plane. A boundary between an outer peripheral face of the punch 22 (outer peripheral face of a body portion) and the top face (punch face 22B) of the punch 22 is formed with the shoulder 22A that has a circular arc shaped cross-section profile.

The die 28 is disposed at the device upper side of the holder 24, and opposes the holder 24 in the device up-down direction. The die 28 is coupled to a mover device 34 serving as an example of a die mover device. The mover device 34 enables the die 28 to move in the device up-down direction.

The burring device 20 is configured such that moving the die 28 toward the device lower side grips the metal stock sheet 10 in the device up-down direction between the die 28 and the holder 24. A pad housing portion 28A, serving as a "housing portion" that houses the pad 26, is formed in a lower face of the die 28 at a position corresponding to the pilot hole 10A in the metal stock sheet 10. The pad housing portion 28A is formed in a recessed shape opening toward the device lower side. In other words, the die 28 includes the pad housing portion 28A that opens toward the device lower side. The pad housing portion 28A is formed in a circular shape as viewed from the device lower side, and is disposed coaxially to the punch housing portion 24A described above. An internal diameter of the pad housing portion 28A is substantially the same as an external diameter D2 (see FIG. 3) of the flange 14 of the burred article 12 after burring.

The pad 26 is formed in a column shape with its axial direction running along the device up-down direction. The pad 26 is housed inside the pad housing portion 28A. The pad 26 is thereby disposed opposing the punch 22 in the sheet thickness direction of the metal stock sheet 10. The pad 26 is disposed coaxially to the pilot hole 10A in the metal stock sheet 10, and also to the punch 22. An upper end portion of the pad 26 is coupled to a pad pressing device 32. The pad pressing device 32 is, for example, configured by a gas cushion, a hydraulic device, a spring, or an electrically powered device. The pad 26 is thereby coupled so as to be capable of being moved in the device up-down direction relative to the die 28 by the pad pressing device 32. A lower face of the pad 26 (namely, an opposing face that opposes the punch face 22B of the punch 22 in the device up-down direction) configures a pad face 26A. The pad face 26A is formed in a plane orthogonal to the device up-down direction. During burring, the pad face 26A is parallel to the upper face (the face on the one sheet thickness direction side) of the metal stock sheet 10 placed on the holder 24, and also to the punch face 22B of the punch 22. Note that as described above, the pad 26 is coupled to (integrated together with) the die 28 by the pad pressing device 32. However, the die 28 may be configured as a separate unit to the pad 26 and the pad pressing device 32. For example, configuration may be made in which the pad housing portion 28A is configured by a hole penetrating in the device up-down direction, and with the die 28 being configured as a separate unit to the pad 26 and the pad pressing device 32.

The pad face 26A of the pad 26 is capable of moving from the interior side (device upper side) of the pad housing portion 28A to at least a position aligned with an opening face 28B of the pad housing portion 28A.

The pad 26 holds the peripheral rim 10B of the pilot hole 10A in the metal stock sheet 10 in place. The internal diameter d of the pilot hole 10A is determined according to the height of the flange of the burred article. An external diameter D5 of the pad 26 is preferably large in order to enable processing of any internal diameter d of the pilot hole 10A. However, the external diameter D5 of the pad 26 is set smaller than an internal diameter D7 of the pad housing portion 28A in order to allow the pad 26 to move inside the pad housing portion 28A. For example, the external diameter D5 of the pad 26 is the same dimension as an external diameter D4 of the punch face 22B of the punch 22 (as an example, in the present exemplary embodiment, the external diameter D5 is 50 mm). Moreover, the pad face 26A of the pad 26 is formed with a hardened surface layer by performing surface processing such as quenching, nitriding, or applying a surface-strengthening coating. This is in order to reduce damage to the pad face 26A caused by the pad face 26A scraping against the edge of the pilot hole 10A in the metal stock sheet 10.

As illustrated in FIG. 1, the burring device 20 further includes a controller 36 that controls the mover device 30 and the mover device 34. The controller 36 controls at least one of the mover device 30 or the mover device 34 such that the punch 22 and the pad 26 press the peripheral rim 10B of the pilot hole 10A in the metal stock sheet 10 in the sheet thickness direction of the metal stock sheet 10. Note that when this is performed, the pad 26 is moved by the pad pressing device 32 to a position aligned with the opening face 28B of the pad housing portion 28A. In this pressing state, the controller 36 controls at least one of the mover device 30 or the mover device 34 to move the punch 22 relative to the metal stock sheet 10 toward the other sheet thickness direction side as illustrated in FIG. 2B, such that the punch 22 extrudes the peripheral rim 10B of the pilot hole 10A so as to form the flange 14 (see FIG. 2C).

Note that burring devices according to an aspect of the present disclosure may be classified as types (A) to (C) below. The burring device 20 may include each of the mover device 30, the mover device 34, and the holder pressing device 60 so as to be capable of performing the processing of each of (A) to (C).

(A) The holder 24 is fixed, and the die 28 is lowered by the mover device 34 to hold the metal stock sheet 10. Burring is performed by raising the punch 22 with the mover device 30.

(B) The die 28 is fixed, the holder pressing devices 60 (see FIG. 11) are coupled below the holder 24, and the holder 24 is raised by the holder pressing device 60 to hold the metal stock sheet 10. Burring is performed by raising the punch 22 with the mover device 30.

(C) The holder pressing devices 60 (see FIG. 11) are coupled below the holder 24, the die 28 is lowered by the mover device 34, and the metal stock sheet 10 is held by the die 28 and the holder 24, which is being pressed upward by the holder pressing device 60. The punch 22 is fixed, and burring is performed by lowering the die 28 with the mover device 34, pressing the die 28 against the holder 24, and lowering the metal stock sheet 10 held by the die 28 and the holder 24.

In the burring device 20, the peripheral rim 10B of the pilot hole 10A in the metal stock sheet 10 is pressed in the device up-down direction (the sheet thickness direction of the metal stock sheet 10) by the pad 26 (pad face 26A) and the punch 22 (punch face 22B) by moving the pad 26 toward the device lower side with the pad pressing device 32. Specifically, the pad face 26A of the pad 26 contacts the metal stock sheet 10 tightly at the upper face of the peripheral rim 10B of the pilot hole 10A, and the punch face 22B of the punch 22 contacts the metal stock sheet 10 tightly at the lower face of the peripheral rim 10B of the pilot hole 10A. Substantially the entire peripheral rim 10B of the pilot hole 10A in the metal stock sheet 10 is thereby pressed by the pad 26 and the punch 22. Note that in the present exemplary embodiment, the peripheral rim 10B of the pilot hole 10A in the metal stock sheet 10 is pressed by the pad 26 and the punch 22 at least at an end 10C on the pilot hole 10A side of the peripheral rim 10B. Note that the pressing force on the metal stock sheet 10 from the pad 26 and the punch 22 is set as appropriate according to the sheet thickness, material, and so on of the metal stock sheet 10. Namely, an appropriate pressing force is set such that in a second process of the burring method, described later, the end 10C of the peripheral rim 10B of the pilot hole 10A in the metal stock sheet 10 moves relative to the pad 26 and the punch 22 by sliding between the pad 26 and the punch 22, such that the flange 14 is ultimately formed to the burred article 12.

Burring Method

Next, explanation follows regarding the burring method of the first exemplary embodiment. The burring method includes a first process, serving as an example of a "placement process" as described below, and a second process, serving as an example of an "extrusion process".

Figure 2A:
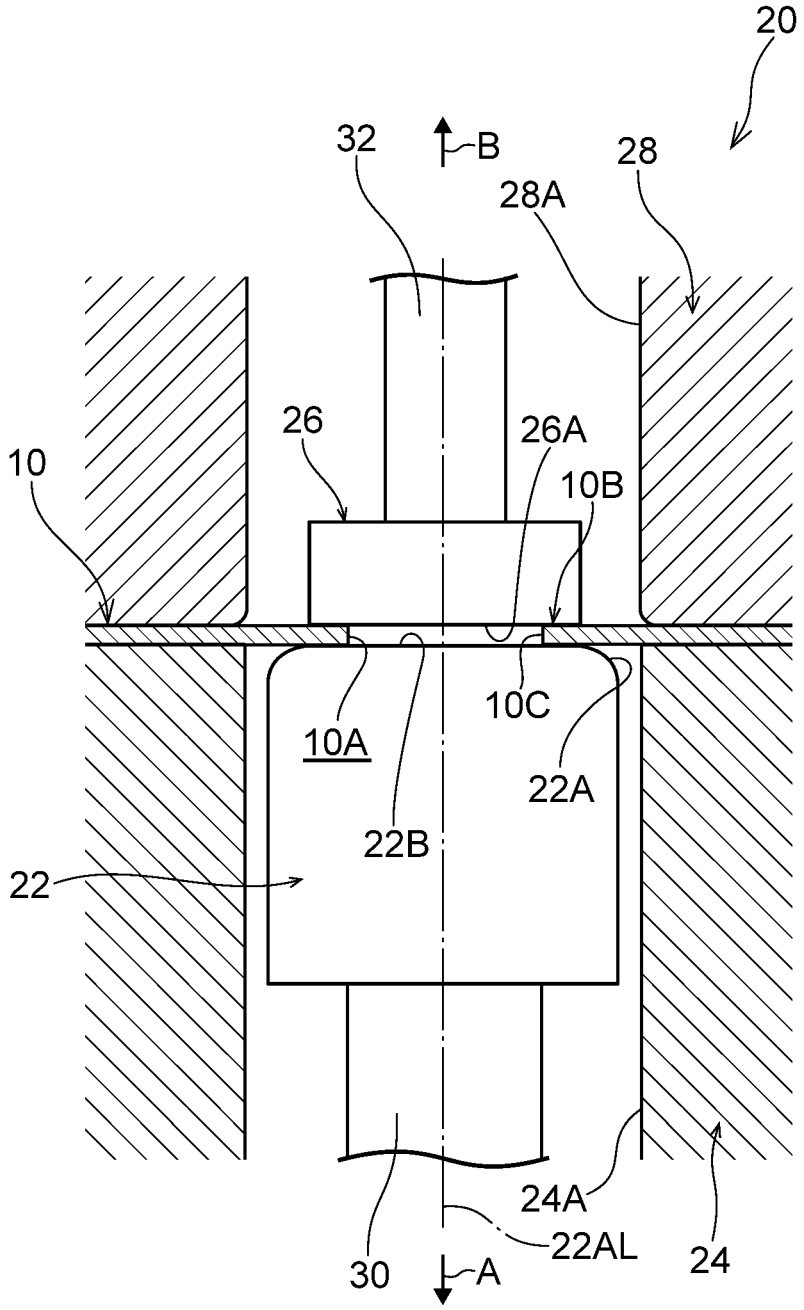
FIG. 2A is a cross-section illustrating a first process of a burring method according to the first exemplary embodiment.
Figure 2B:
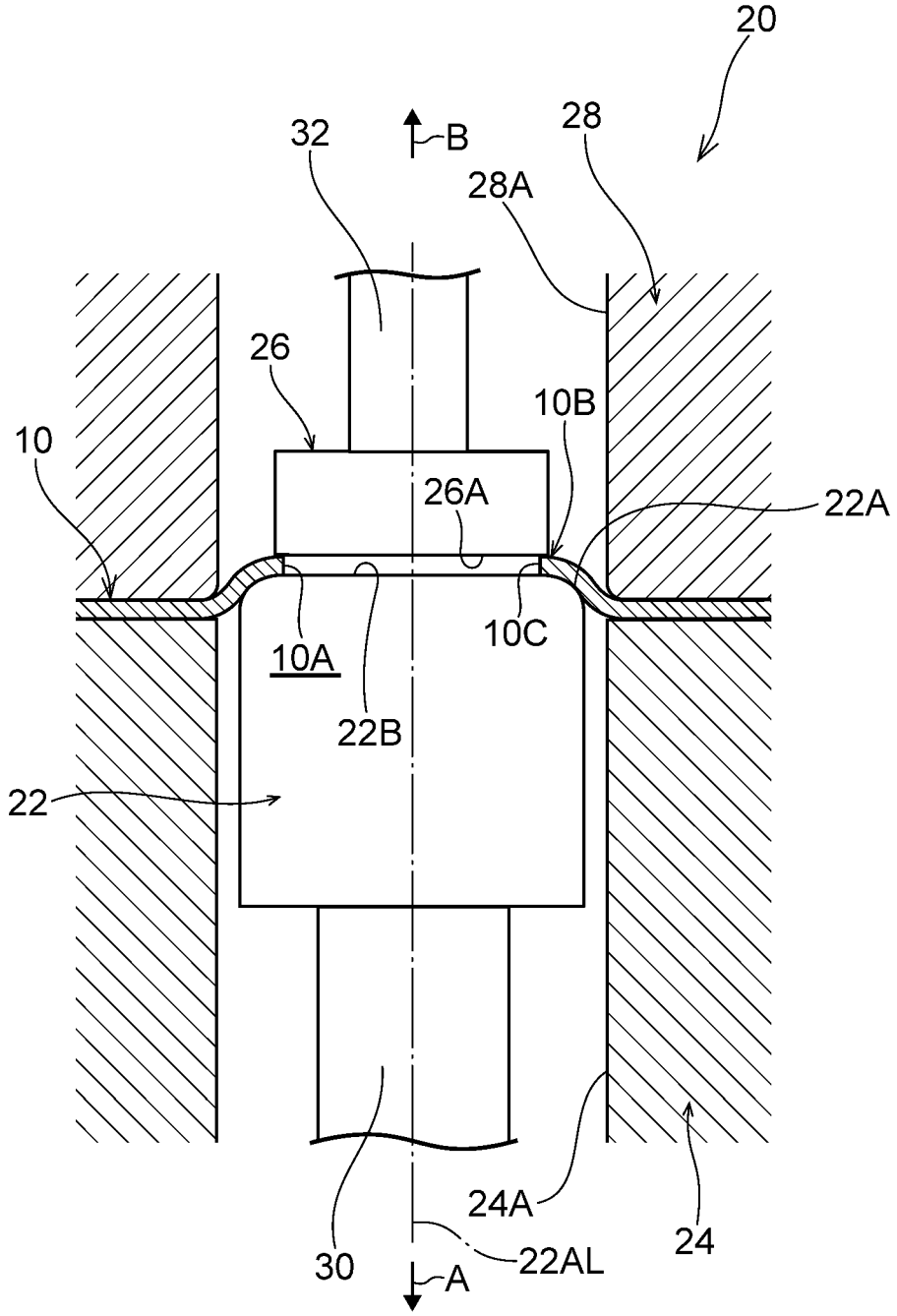
FIG. 2B is a cross-section illustrating a point partway through a second process of the burring method.

As illustrated in FIG. 1 and FIG. 2A, in the first process the metal stock sheet 10 is disposed such that the punch 22 is positioned on the one sheet thickness direction side of the metal stock sheet 10, and the pad 26 is positioned on the opposite side to the one sheet thickness direction side (the other side) of the metal stock sheet 10.

When this is performed, either the punch face 22B of the punch 22 and the upper face of the holder 24 are disposed in the same plane, or the punch face 22B of the punch 22 is lower than the upper face of the holder 24. In this state, the metal stock sheet 10 formed with the pilot hole 10A is placed (set) on the holder 24. Specifically, the metal stock sheet 10 is placed (set) on the holder 24 in a state in which the center of the pilot hole 10A in the metal stock sheet 10 is disposed coaxially to the punch 22.

Then, either the die 28 is moved toward the device lower side, or the holder 24 is raised, thereby gripping the metal stock sheet 10 between the die 28 and the holder 24. Namely, the metal stock sheet 10 is gripped by the die 28 and the holder 24 at a portion other than the peripheral rim 10B of the pilot hole 10A.

Moreover, in this state, the pad 26 is moved toward the device lower side by the pad pressing device 32, and the peripheral rim 10B of the pilot hole 10A in the metal stock sheet 10 is pressed by the pad 26 (pad face 26A) and the punch 22 (punch face 22B) in the device up-down direction (in the sheet thickness direction of the metal stock sheet 10). Namely, in the present exemplary embodiment, in the first process, the peripheral rim 10B of the pilot hole 10A in the metal stock sheet 10 is pressed by the pad 26 and the punch 22. In other words, the peripheral rim 10B of the pilot hole 10A in the metal stock sheet 10 is gripped and pressed by the pad 26 and the punch 22 from the beginning of the second process, described next. Note that in cases in which the punch face 22B of the punch 22 is lower than the upper face of the holder 24, the peripheral rim 10B of the pilot hole 10A in the metal stock sheet 10 is pressed in the device up-down direction by the pad 26 and the punch 22 after the punch face 22B of the punch 22 has entered the same plane as the upper face of the holder 24.

In the second process, from the state illustrated in FIG. 2A, the mover device 30 moves the punch 22 toward the device upper side relative to the die 28 and the holder 24, against the pressing force of the pad pressing device 32. When this is performed, the punch 22 and the pad 26 are moved toward the device upper side relative to the die 28 and the holder 24 while maintaining the pressed state of the peripheral rim 10B of the pilot hole 10A in the metal stock sheet 10 by the punch 22 and the pad 26. When this is performed, the peripheral rim 10B of the pilot hole 10A in the metal stock sheet 10 that is being pressed by the punch 22 and the pad 26 is formed into a cylinder shape while being extruded toward the device upper side by the punch 22 (see FIG. 2B). Specifically, the peripheral rim 10B of the pilot hole 10A in the metal stock sheet 10 is bent into a substantially S-shape by the shoulder 22A of the punch 22 and a shoulder of the die 28 as viewed in a vertical cross-section plane. Moreover, accompanying the movement of the punch 22 and the pad 26 toward the device upper side, the inner peripheral face of the pilot hole 10A moves toward the radial direction outer side of the punch 22 between the punch 22 and the pad 26. Namely, the peripheral rim 10B of the pilot hole 10A is formed into a cylinder shape, while the pilot hole 10A gradually widens (increases in diameter). Finally, the end 10C of the peripheral rim 10B of the pilot hole 10A comes out from between the punch 22 and the pad 26, and the pressed state of the peripheral rim 10B of the pilot hole 10A in the metal stock sheet 10 by the punch 22 and the pad 26 is released.

Similar relative movement between the punch 22 and the die 28 enables similar burring to be performed. Similar burring can also be performed by fixing the punch 22 and lowering the die 28 in the second process.

Figure 2C:
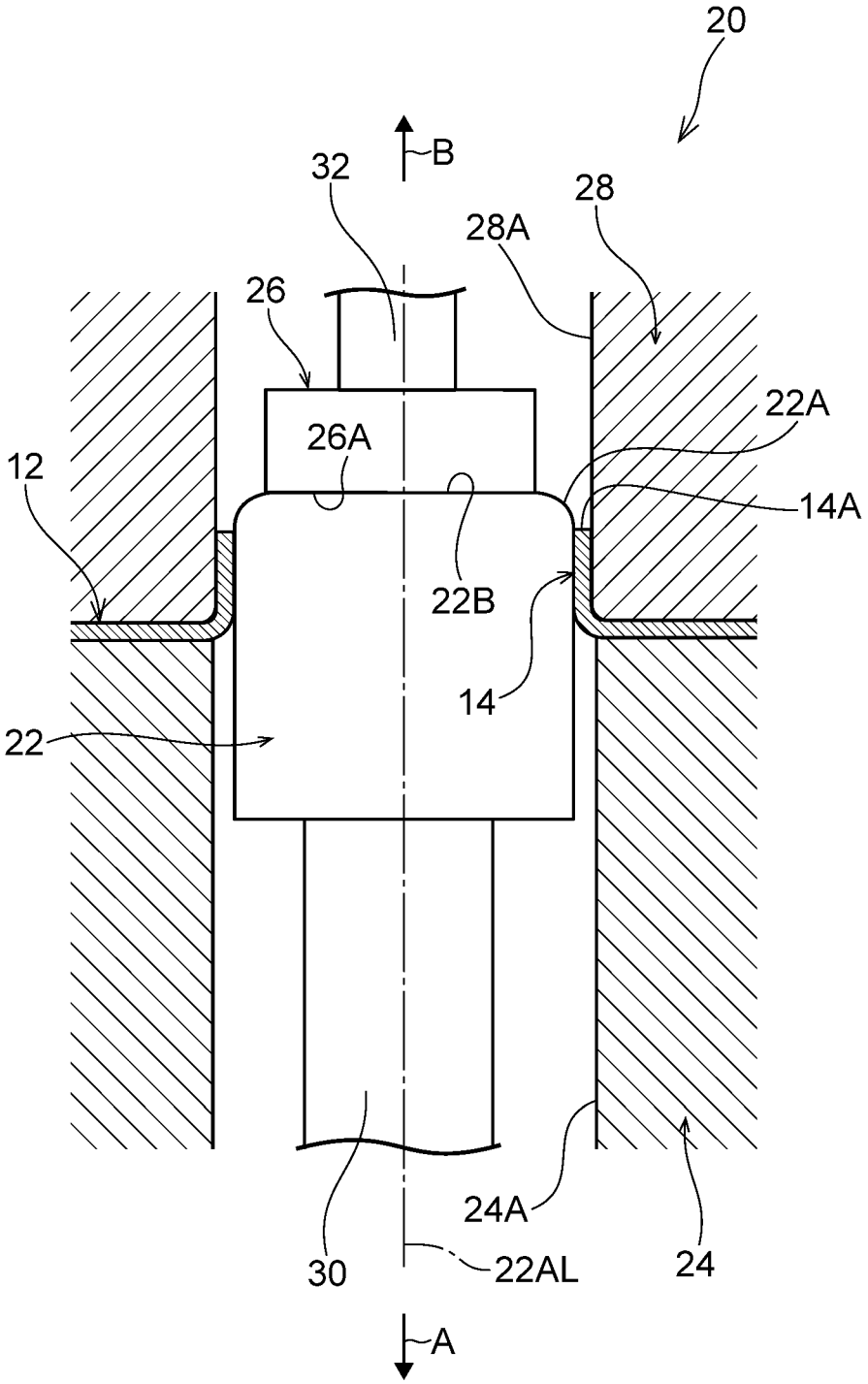
FIG. 2C is a cross-section illustrating the end of the second process of the burring method.

As illustrated in FIG. 2C, at the end of the second process, after the end 10C of the peripheral rim 10B of the pilot hole 10A comes out from between the punch 22 and the pad 26, the punch 22 is inserted inside the flange 14. Moreover, when the end 10C of the peripheral rim 10B of the pilot hole 10A comes out from between the punch 22 and the pad 26, the flange 14 is disposed at the radial direction outer side of the pad 26. The pressing force of the pad pressing device 32 moves the pad 26 toward the device lower side relative to the punch 22. The flange 14 is formed to the burred article 12 in this manner.

Next, explanation follows regarding operation and advantageous effects of the present exemplary embodiment, drawing comparison with a burring method of a comparative example. Note that in the burring method of the comparative example, a burring device that is not provided with the pad 26 and the pad pressing device 32 of the present exemplary embodiment is employed to apply a burr to a metal stock sheet 10. Note that in the burring device of the comparative example, members configured similarly to those of the burring device 20 of the present exemplary embodiment are explained using the same reference numerals.

Figure 4A:
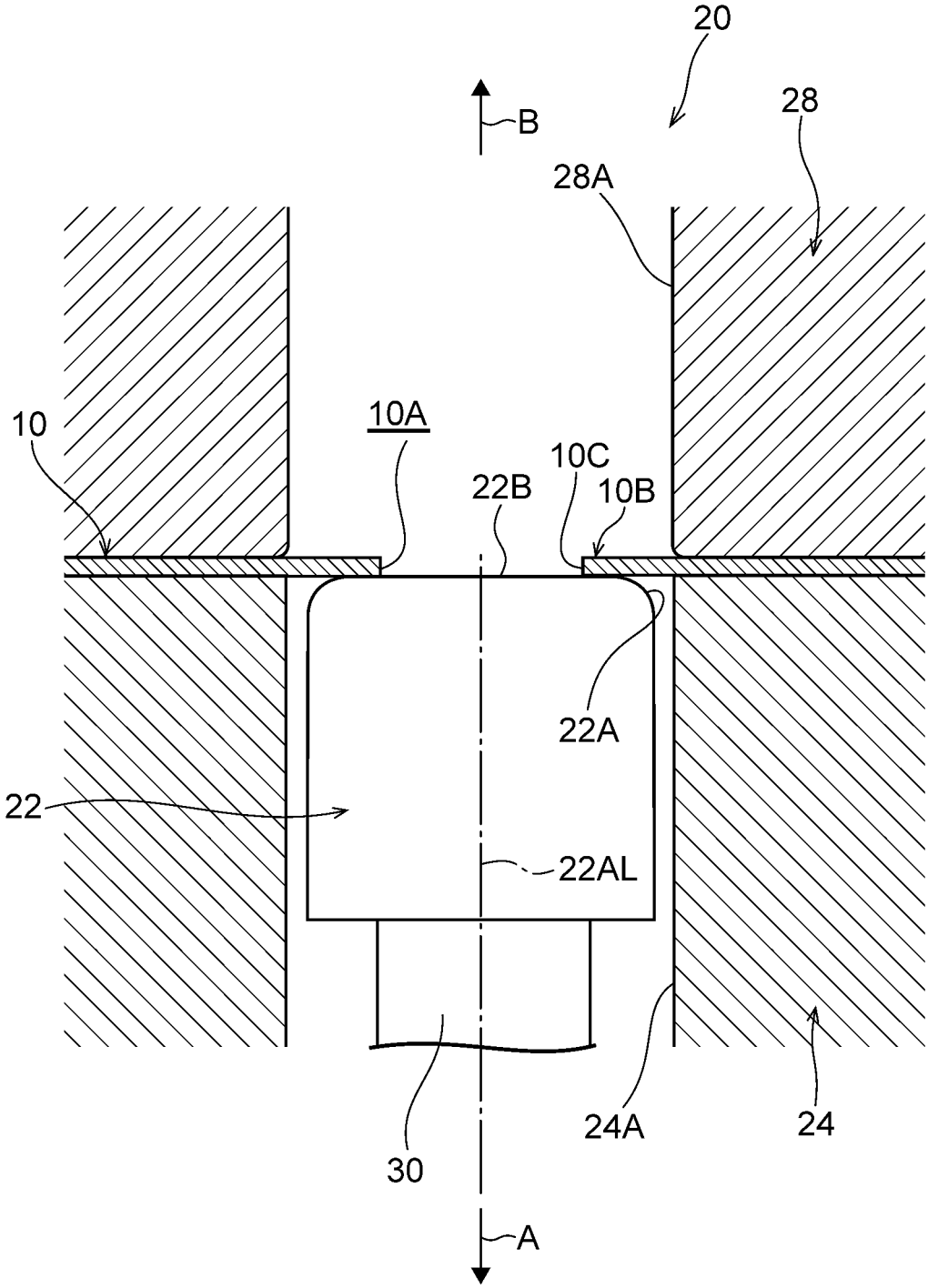
FIG. 4A is a cross-section illustrating a state prior to burring in a burring method of a comparative example.

As illustrated in FIG. 4A, in the burring method of the comparative example, similarly to in the present exemplary embodiment, the punch face 22B of the punch 22 is in the same plane as the upper face of the holder 24, or is lower than the upper face. In this state, the metal stock sheet 10 formed with the pilot hole 10A is placed (set) on the holder 24. Then, either the die 28 is moved toward the device lower side, or the holder 24 is raised, in order to grip the metal stock sheet 10 with the die 28 and the holder 24.

Figure 4B:
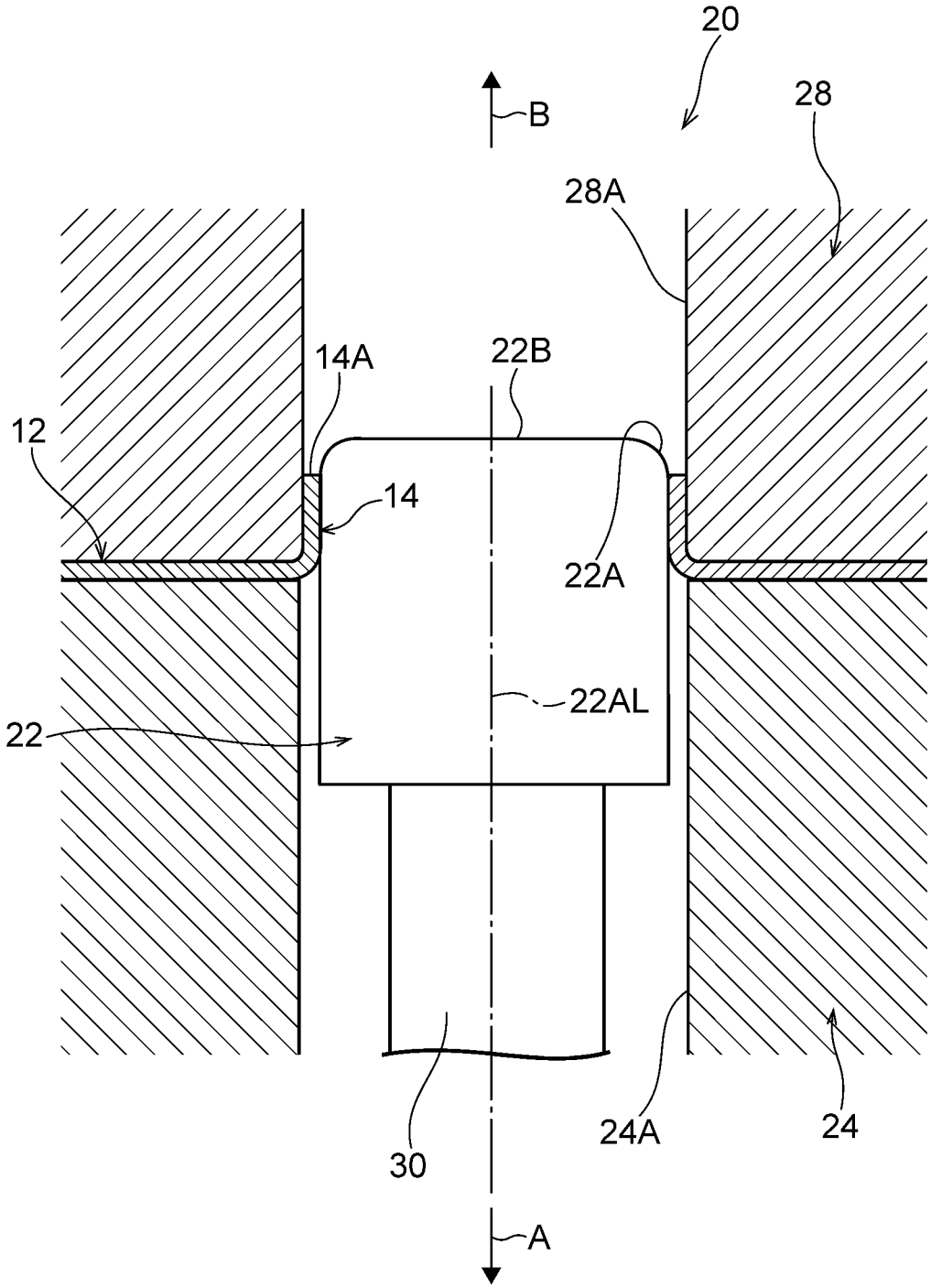
FIG. 4B is a cross-section illustrating a state after burring in a burring method of a comparative example.

Then, as illustrated in FIG. 4B, the mover device 30 moves the punch 22 toward the device upper side relative to the die 28 and the holder 24. Alternatively, the mover device 34 moves the die 28 and the holder 24 toward the device lower side. When this is performed, the peripheral rim 10B of the pilot hole 10A in the metal stock sheet 10 is extruded toward the device upper side by the punch 22, thereby forming the metal stock sheet 10 with the flange 14.

Note that during burring, the peripheral rim 10B of the pilot hole 10A formed in the metal stock sheet 10 is extruded by the punch 22 to shape the cylindrical flange 14. Accordingly, a leading end portion of the flange 14 after shaping (referred to hereafter as the "leading end portion 14A" for convenience) is stretched along the peripheral direction of the flange 14. Namely, the shaping of the flange 14 with the punch 22 is what is referred to as "stretch flanging" (in which the flange is shaped in a stretched state). The metal stock sheet 10 is a high strength steel sheet with a tensile strength of 440 MPa or greater (590 MPa in the present exemplary embodiment), and the metal stock sheet 10 has relatively low ductility. Accordingly, as illustrated in FIG. 5, when such a high strength steel sheet with a tensile strength of 590 MPa and a sheet thickness of 2.9 mm is subjected to a hole enlargement factor of 0.67 when performing burring as in the comparative example, cracking occurs in the leading end portion 14A of the flange 14 after shaping (see the portions a in FIG. 5).

By contrast, in the burring method of the first exemplary embodiment, as described above, the flange 14 is formed while pressing the peripheral rim 10B of the pilot hole 10A in the metal stock sheet 10 in the sheet thickness direction of the metal stock sheet 10 by the punch 22 and the pad 26. It is known that the ductility of a material increases when under hydrostatic pressure in which compression force is applied from the surroundings of the material. The ductility of the peripheral rim 10B of the pilot hole 10A when shaping the flange 14 can thus be increased by compressing the peripheral rim 10B of the pilot hole 10A in the metal stock sheet 10. Moreover, in the present exemplary embodiment, the peripheral rim 10B of the pilot hole 10A in the metal stock sheet 10 is pressed in the sheet thickness direction of the metal stock sheet 10 by the punch 22 and the pad 26. The peripheral rim 10B of the pilot hole 10A can thus be placed under pseudo-hydrostatic pressure due to the compression force acting on the peripheral rim 10B of the pilot hole 10A in the sheet thickness direction. Accordingly, the flange 14 can be formed in a state in which the ductility of the peripheral rim 10B of the pilot hole 10A in the metal stock sheet 10 has been raised in comparison to in the comparative example. In other words, the burring method of the present exemplary embodiment enables stretch-flanging with a higher hole enlargement factor limit than in the comparative example. As a result, cracking of the leading end portion 14A of the flange 14 after shaping can be suppressed, even when employing a material with comparatively low ductility, such as a high strength steel sheet. Due to the above, cracking of the leading end portion 14A of the flange 14 after shaping can be suppressed without setting the shape of the punch 22 according to the pilot hole 10A in the metal stock sheet 10. Note that "under hydrostatic pressure" typically refers to a state in which a material is submerged in water, and due to water pressure, the material is applied with uniform pressure from its surroundings. In the present disclosure, however, "under hydrostatic pressure" refers to a state in which compression force is applied to the material from its surroundings under atmospheric pressure, without submerging the material in water.

In the burring method of the first exemplary embodiment, at least the end 10C of the peripheral rim 10B of the pilot hole 10A in the metal stock sheet 10 is formed into the flange 14 while being pressed in the sheet thickness direction of the metal stock sheet 10 by the punch 22 and the pad 26. This thereby enables the flange 14 to be formed in a state in which the end 10C of the peripheral rim 10B of the pilot hole 10A in the metal stock sheet 10 has heightened ductility, enabling cracking of the leading end portion 14A of the flange 14 after shaping to be further suppressed.

The burring method of the first exemplary embodiment has been confirmed not to cause cracking of the leading end portion 14A of the flange 14 after shaping, even when applying a burr to a high strength steel sheet with tensile strength of 590 MPa and a sheet thickness of 2.9 mm with a hole enlargement factor of 0.67. Moreover, the burring method of the first exemplary embodiment has been confirmed not to cause cracking of the leading end portion 14A of the flange 14 after shaping, even when using a high strength steel sheet with a tensile strength of 980 MPa and a sheet thickness of 2.9 mm.

Moreover, in the first exemplary embodiment, the peripheral rim 10B of the pilot hole 10A in the metal stock sheet 10 is pressed in the sheet thickness direction of the metal stock sheet 10 by the punch 22 and the pad 26 from the beginning of the second process. Accordingly, the flange 14 can be shaped in a state in which the peripheral rim 10B of the pilot hole 10A in the metal stock sheet 10 has heightened ductility from the start of shaping of the flange 14 with the punch 22. This thereby enables cracking of the leading end portion 14A of the flange 14 after shaping to be effectively suppressed.

Moreover, in the first exemplary embodiment, cracking of the leading end portion 14A of the flange 14 can be suppressed by pressing the peripheral rim 10B of the pilot hole 10A in the metal stock sheet 10 with the punch 22 and the pad 26. This thereby enables cracking of the leading end portion 14A of the flange 14 to be suppressed without setting the shape of the punch 22 according to the shape of the pilot hole 10A in the metal stock sheet 10, as in burring methods of related technology. This thereby enables cracking of the leading end portion 14A of the flange 14 to be suppressed using a highly versatile device configuration.

Second Exemplary Embodiment

Figure 6:
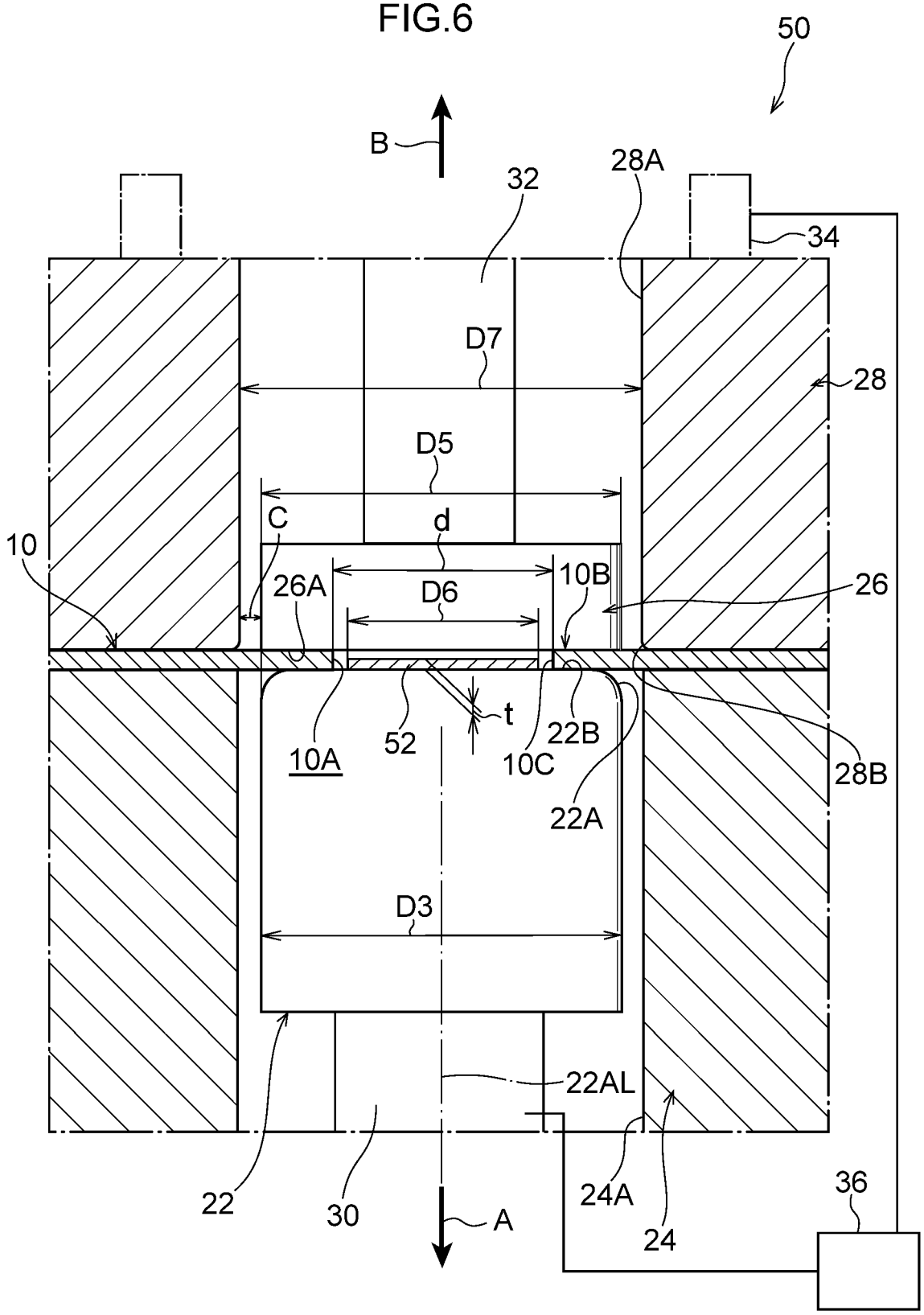
FIG. 6 is a cross-section illustrating relevant portions of a burring device employed in a burring method according to a second exemplary embodiment.
Figure 7:
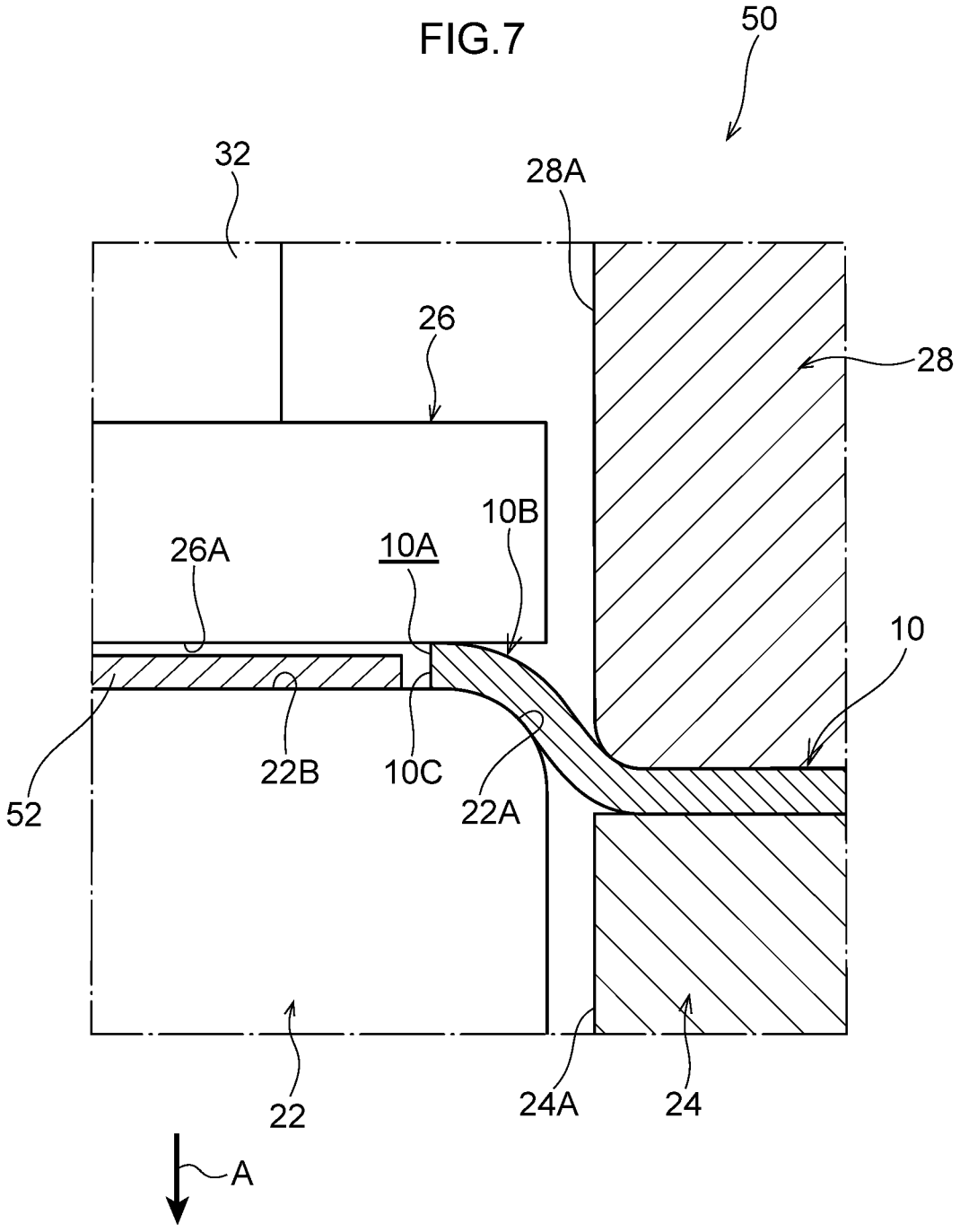
FIG. 7 is an enlarged partial cross-section illustrating a point partway through a second process of the burring method according to the second exemplary embodiment.
Figure 8:
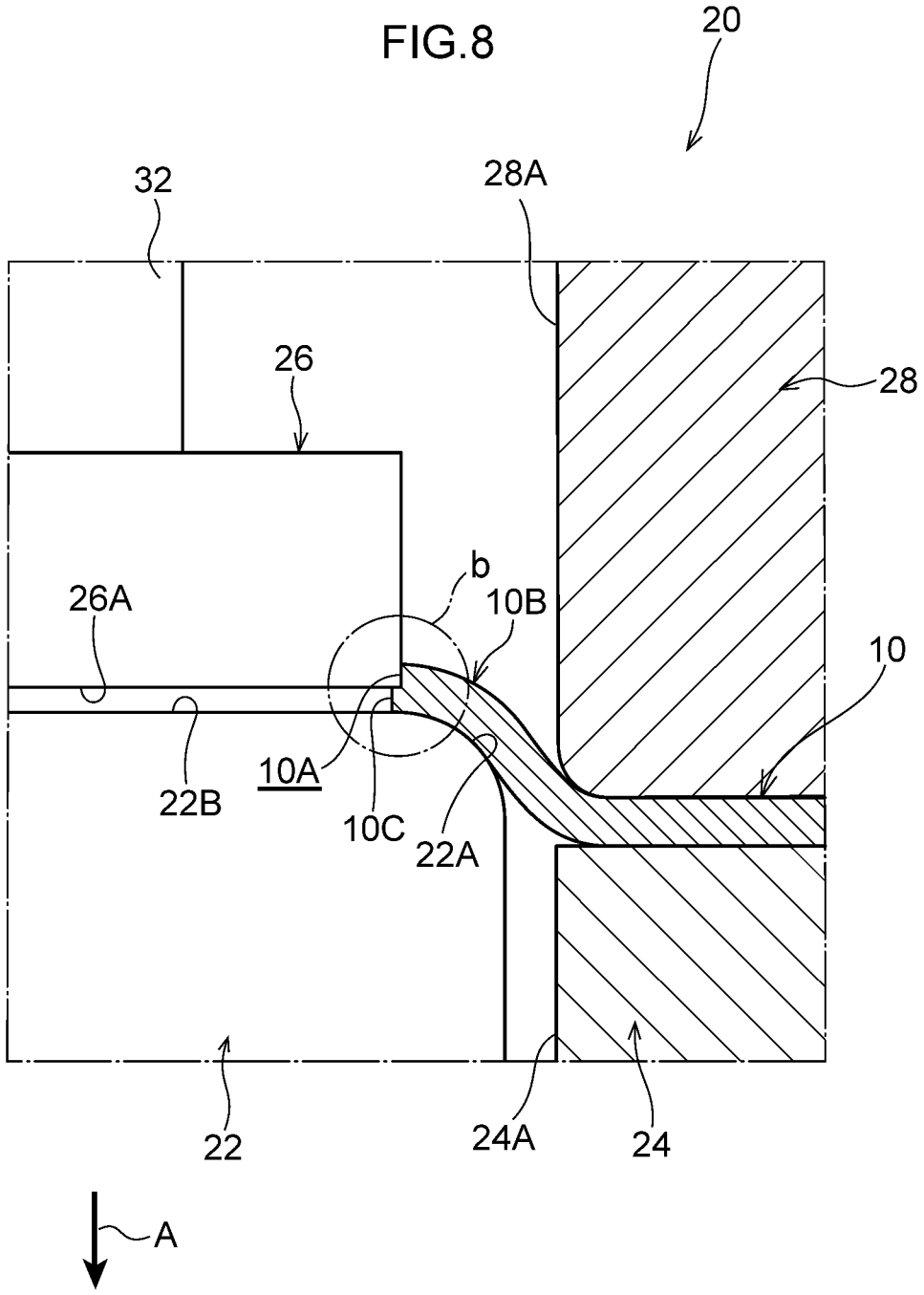
FIG. 8 is a cross-section to explain shearing of a metal stock sheet by a pad in the second process of the burring method according to the first exemplary embodiment.

Explanation follows regarding a burring method of a second exemplary embodiment, with reference to FIG. 6 to FIG. 8. Note that in the second exemplary embodiment, a different device to the burring device 20 of the first exemplary embodiment is used to apply a burr to a metal stock sheet 10. Explanation follows regarding a burring device 50 of the second exemplary embodiment, followed by explanation regarding the burring method of the second exemplary embodiment.

Burring Device 50

As illustrated in FIG. 6, the burring device 50 is configured similarly to the burring device 20 of the first exemplary embodiment, with the exception of the following points. Note that in the following explanation, portions of the burring device 50 configured similarly to those of the burring device 20 are allocated the same reference numerals.

A substantially circular disc shaped spacer 52 (also referred to as a "shim") is provided on the punch face 22B of the punch 22. The spacer 52 is fixed to the punch 22. The spacer 52 is disposed coaxially to the punch 22, and an external diameter D6 of the spacer 52 is smaller than the internal diameter d of the pilot hole 10A in the metal stock sheet 10. Accordingly, in a state in which the metal stock sheet 10 has been placed in the burring device 50, the spacer 52 is disposed at the inside of the pilot hole 10A in the metal stock sheet 10. Moreover, in this placement state, the spacer 52 is interposed between the punch 22 and the pad 26.

A sheet thickness t of the spacer 52 is a predetermined sheet thickness, and is thinner than the sheet thickness of the metal stock sheet 10 (in the present exemplary embodiment, the sheet thickness t (1.9 mm) of the spacer 52 is approximately 66% the sheet thickness (2.9 mm) of the metal stock sheet 10). Namely, in a state in which the metal stock sheet 10 has been placed on the burring device 50, the spacer 52 does not project to the device upper side of the upper face of the metal stock sheet 10. The sheet thickness t of the spacer 52 is also smaller than a radial direction clearance C between the punch 22 and the die 28. Note that the predetermined sheet thickness of the spacer 52 is determined based on the sheet thickness of the flange 14 after thinning, for example computed using simulations of the thinning of the flange 14 based on the hole enlargement factor of the flange 14 during burring. Specifically, the sheet thickness t of the spacer 52 is set as a slightly thinner sheet thickness than the sheet thickness of the flange 14 after thinning. Namely, as will be described in detail later, were the sheet thickness t of the spacer 52 to be greater than the sheet thickness of the flange 14 after thinning, the pressing force of the pad 26 and the punch 22 on the metal stock sheet 10 would decrease toward the end of a second process of the burring method, described later. However, were the sheet thickness t of the spacer 52 to be set very thin in comparison to the flange 14 after thinning, there would be a possibility of scrap being left on the leading end portion 14A of the flange 14 after shaping. The sheet thickness t of the spacer 52 is therefore set to a slightly thinner sheet thickness than the sheet thickness of the flange 14 after thinning, as described above.

Next, explanation follows regarding the burring method of the second exemplary embodiment. Similarly to the first exemplary embodiment, the burring method of the second exemplary embodiment includes a first process, serving as an example of a "placement process", and a second process, serving as an example of an "extrusion process".

As illustrated in FIG. 6, in the first process, the metal stock sheet 10 is disposed such that the punch 22 is positioned on the one sheet thickness direction side of the metal stock sheet 10, and the pad 26 is positioned on the opposite side (the other side) of the metal stock sheet 10 to the one sheet thickness direction side.

Moreover, either the punch face 22B of the punch 22 and the upper face of the holder 24 are in the same plane as each other, or the punch face 22B is lower than the upper face of the holder 24. In this state, the metal stock sheet 10 formed with the pilot hole 10A is placed (set) on the holder 24. Specifically, the metal stock sheet 10 is placed (set) on the holder 24 in a state in which the pilot hole 10A in the metal stock sheet 10 is disposed coaxially to the punch 22. When this is performed, the spacer 52 is disposed inside the pilot hole 10A in the metal stock sheet 10, and the spacer 52 does not project out to the device upper side of the upper face of the metal stock sheet 10.

Then, either the die 28 is moved toward the device lower side, or the holder 24 is raised, thereby gripping the metal stock sheet 10 with the die 28 and the holder 24. Specifically, portions of the metal stock sheet 10 other than the peripheral rim 10B of the pilot hole 10A are gripped by the die 28 and the holder 24. Instead of moving the die 28 toward the device lower side, the holder 24 may be raised in order to grip the metal stock sheet 10 with the die 28 and the holder 24.

Then, in this state, the pad pressing device 32 moves the pad 26 toward the device lower side, and the peripheral rim 10B of the pilot hole 10A in the metal stock sheet 10 is pushed toward the lower side. If the punch 22 is not contacting the lower side of the metal stock sheet 10, the punch 22 is raised until the punch 22 contacts the metal stock sheet 10. When this is performed, since the spacer 52 does not project to the device upper side of the upper face of the metal stock sheet 10, a gap is formed between the upper face of the spacer 52 and the pad face 26A of the pad 26. The peripheral rim 10B of the pilot hole 10A in the metal stock sheet 10 is thereby pressed in the device up-down direction (sheet thickness direction of the metal stock sheet 10) by the pad 26 and the punch 22. Namely, in the second exemplary embodiment, in the first process, the peripheral rim 10B of the pilot hole 10A in the metal stock sheet 10 is pressed by the pad 26 and the punch 22. In other words, the peripheral rim 10B of the pilot hole 10A in the metal stock sheet 10 is pressed by the pad 26 and the punch 22 from the beginning of the second process, described next.

In the second process, from the state illustrated in FIG. 6, the mover device 30 moves the punch 22 toward the device upper side relative to the die 28 and the holder 24, against the pressing force of the pad pressing device 32. Alternatively, the mover device 34 lowers the die 28 in a state in which the metal stock sheet 10 is gripped by the die 28 and the holder 24. When this is performed, the punch 22 and the pad 26 are moved toward the device upper side relative to the die 28 and the holder 24, while maintaining the pressed state of the peripheral rim 10B of the pilot hole 10A in the metal stock sheet 10 by the punch 22 and the pad 26. Moreover, when this is performed, the peripheral rim 10B of the pilot hole 10A in the metal stock sheet 10 pressed by the punch 22 and the pad 26 is formed into a cylinder shape (see FIG. 7) while being extruded toward the device upper side by the punch 22. Moreover, although not illustrated in the drawings, at the end of the second process, the end 10C of the peripheral rim 10B of the pilot hole 10A comes out from between the punch 22 and the pad 26, and the pressed state of the peripheral rim 10B of the pilot hole 10A in the metal stock sheet 10 by the punch 22 and the pad 26 is released. Moreover, after the peripheral rim 10B of the pilot hole 10A has come out from between the punch 22 and the pad 26, the punch 22 is inserted inside the flange 14. When the end 10C of the peripheral rim 10B of the pilot hole 10A has come out from between the punch 22 and the pad 26, the flange 14 is disposed at the radial direction outer side of the pad 26, such that the pad 26 is moved toward the device lower side relative to the punch 22 by the pressing force of the pad pressing device 32.

As described above, in the second exemplary embodiment, the metal stock sheet 10 is formed with the flange 14 while pressing the peripheral rim 10B of the pilot hole 10A in the metal stock sheet 10 with the punch 22 and the pad 26. Accordingly, the second exemplary embodiment is also capable of suppressing cracking of the leading end portion 14A of the flange 14, similarly to the first exemplary embodiment.

Moreover, in the second exemplary embodiment, the spacer 52 is fixed to the punch face 22B of the punch 22, and the spacer 52 is interposed between the punch 22 and the pad 26. This enables the occurrence of scrap on the leading end portion 14A of the flange 14 after shaping to be suppressed. Explanation follows regarding this point, drawing comparison to the first exemplary embodiment.

In the first exemplary embodiment, the spacer 52 is not provided at the punch face 22B of the punch 22. Accordingly, as illustrated in FIG. 8, at the end of the second process, when the end 10C of the peripheral rim 10B of the pilot hole 10A comes out from between the punch 22 and the pad 26, the pad pressing device 32 moves the pad 26 toward the device lower side relative to the punch 22. As the pad 26 moves toward the device lower side, an outer peripheral edge of the pad face 26A of the pad 26 acts so as to shear substantially the entire inner peripheral face of the pilot hole 10A in the metal stock sheet 10 (see portion b in FIG. 8). There is a possibility that the shearing of the inner peripheral face of the pilot hole 10A in the metal stock sheet 10 could leave thread-like scrap (shear scrap) on the leading end portion 14A of the flange 14, or could leave shear marks at a leading end face of the flange 14 after shaping. Moreover, when such scrap occurs, the scrap could scratch the punch 22 or the pad 26. In the first exemplary embodiment, although there is no cracking at the leading end portion 14A of the flange 14, a certain amount of scrap is observed.

By contrast, in the second exemplary embodiment, the spacer 52 is provided at the punch face 22B of the punch 22. At the end of the second process, when the end 10C of the peripheral rim 10B of the pilot hole 10A comes out from between the punch 22 and the pad 26, the pad pressing device 32 moves the pad 26 toward the device lower side relative to the punch 22 similarly to as described above. However, in the second exemplary embodiment, due to providing the spacer 52 between the punch 22 and the pad 26, the amount of movement of the pad 26 relative to the punch 22 is smaller than in the first exemplary embodiment. Accordingly, the outer peripheral edge of the pad face 26A of the pad 26 can be suppressed from being sheared around the entire inner peripheral face of the pilot hole 10A in the metal stock sheet 10. This thereby enables the occurrence of scrap (shear scrap) on the leading end portion 14A of the flange 14 after shaping to be suppressed, and enables shear marks on the leading end face of the flange 14 to be reduced. Moreover, due to suppressing the occurrence of scrap, such scrap can be prevented from scratching the punch 22 or the pad 26.

In the second exemplary embodiment, tests were performed using spacers 52 with the sheet thickness t varied to 2.5 mm, 2.0 mm, and 1.9 mm respectively. No scrap was observed when using the spacers 52 of any of these sheet thicknesses. Note that in the case of the spacer 52 with a sheet thickness t of 1.9 mm (a predetermined sheet thickness), cracking of the leading end portion 14A of the flange 14 did not occur. However, in the cases of the spacer 52 with sheet thicknesses t of 2.5 mm and 2.0 mm, cracking was observed at the leading end portion 14A of the flange 14. This is since, as described above, when shaping the flange 14 with the punch 22, the flange 14 is stretch-shaped and so the sheet thickness of the flange 14 becomes thinner than the sheet thickness of the metal stock sheet 10 prior to shaping. Moreover, in cases in which the sheet thickness t of the spacer 52 is greater than the sheet thickness of the flange 14 after thinning, the pad face 26A of the pad 26 abuts the upper face of the spacer 52 before the end 10C of the peripheral rim 10B of the pilot hole 10A comes out from between the punch 22 and the pad 26, reducing the pressing force of the pad 26 and the punch 22 on the metal stock sheet 10. Accordingly, in the cases in which the sheet thickness of the spacer 52 is 2.5 mm or 2.0 mm, this being thicker than the predetermined sheet thickness, cracking occurred at the leading end portion 14A of the flange 14. Accordingly, setting the sheet thickness of the spacer 52 to the predetermined sheet thickness appropriately, in consideration of the sheet thickness of the flange 14 after thinning, enables scrap to be suppressed while also suppressing cracking of the leading end portion 14A of the flange 14.

In the second exemplary embodiment, the external diameter D5 of the pad 26 is the same dimension as the external diameter D3 of the punch 22. Accordingly, as illustrated in FIG. 7, in the second process, it is possible to delay the timing at which the end 10C of the peripheral rim 10B of the pilot hole 10A comes out from between the punch 22 and the pad 26. Accordingly, the metal stock sheet 10 can be pressed by the pad 26 and the punch 22 until shaping of the flange 14 by the punch 22 is almost complete. This thereby enables cracking of the leading end portion 14A of the flange 14 to be further suppressed. Note that a similar operation and advantageous effect are also obtained by the configuration of the first exemplary embodiment.

Moreover, scrap can also be suppressed as described above by setting the external diameter D5 of the pad 26 to a dimension of the external diameter D3 of the punch 22 or greater. Namely, by setting the external diameter D5 of the pad 26 to a dimension of the external diameter D3 of the punch 22 or greater, the timing at which shaping of the flange 14 by the punch 22 is completed and the timing at which the end 10C of the peripheral rim 10B of the pilot hole 10A comes out from between the punch 22 and the pad 26 can be made substantially simultaneous. Accordingly, when the pad 26 moves toward the device lower side, the peripheral rim 10B of the pilot hole 10A in the metal stock sheet 10 has already been moved to the radial direction outer side of the punch 22 and shaped into the flange 14. The outer peripheral edge of the pad face 26A of the pad 26 is thereby suppressed from shearing the inner peripheral face of the pilot hole 10A in the metal stock sheet 10. This thereby enables the occurrence of scrap to be further suppressed.

In the second exemplary embodiment, the sheet thickness t of the spacer 52 is smaller than the radial direction clearance C between the punch 22 and the die 28. However, the sheet thickness t may be the clearance C or greater. Such a configuration enables the flange to be ironed at the same time as applying the burr.

Modified Example of Pad 26

Figure 9:
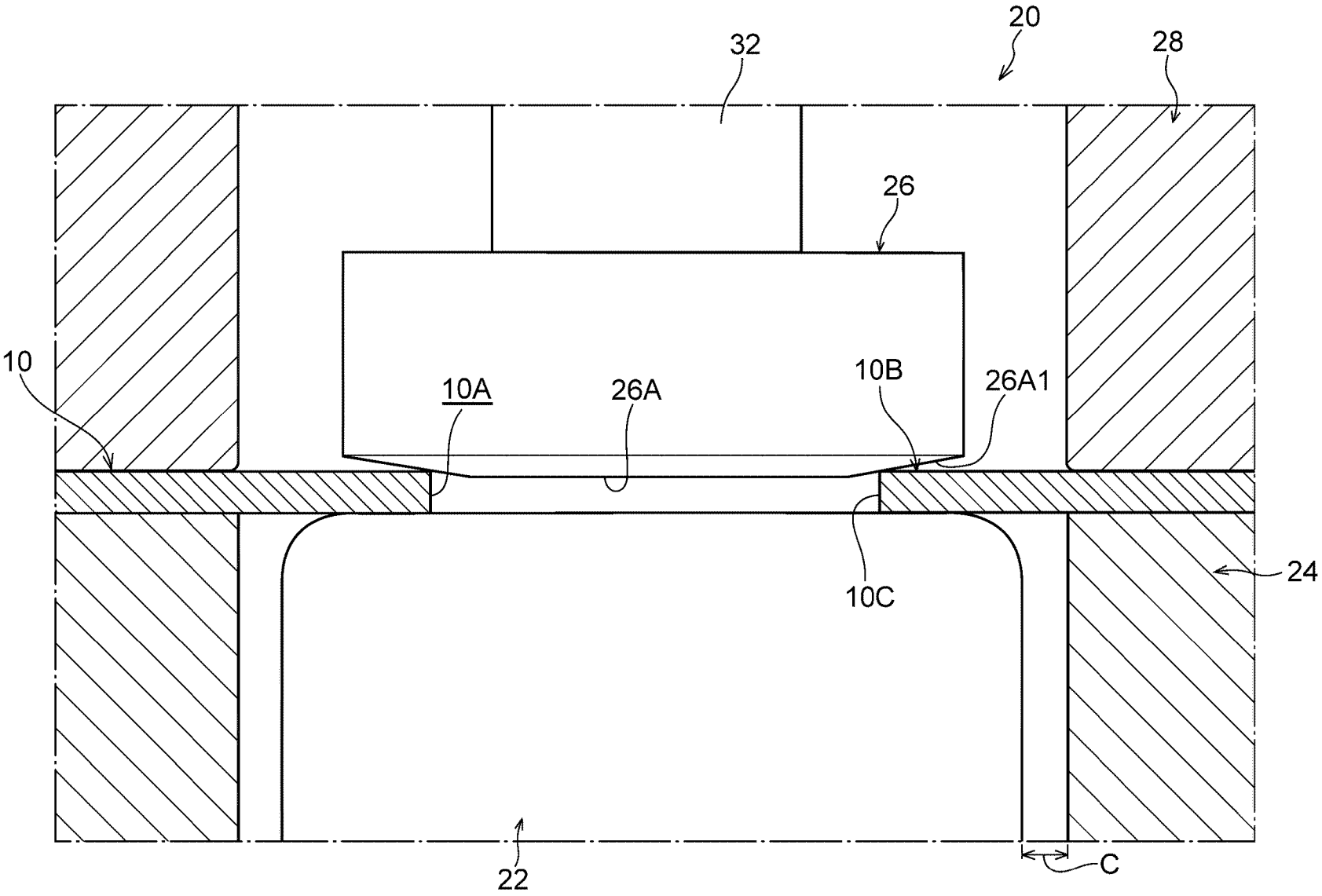
FIG. 9 is a cross-section illustrating a modified example of a pad illustrated in FIG. 1.

Next, explanation follows regarding a modified example of the pad 26, with reference to FIG. 9. FIG. 9 illustrates an example in which the modified example has been applied to the burring device 20 of the first exemplary embodiment. Moreover, in FIG. 9, portions configured similarly to in the first exemplary embodiment are allocated the same reference numerals. In the present modified example, a radial direction outer side portion (a portion on the outer peripheral side) of the pad face 26A of the pad 26 is formed with an inclined face 26A1. The inclined face 26A1 is inclined toward the device upper side (a direction away from the punch 22) on progression toward the radial direction outer side of the pad face 26A. In a gripped state of the metal stock sheet 10 by the punch 22 and the pad 26, the end 10C of the peripheral rim 10B of the pilot hole 10A in the metal stock sheet 10 abuts the inclined face 26A1. This thereby enables the gripped state of the end 10C of the pilot hole 10A in the metal stock sheet 10 by the punch 22 and the pad 26 to be maintained from the first process until the end of the second process.

Namely, when applying the flange 14 to the metal stock sheet 10, it may be expected that the amount of thinning would be greatest at the end 10C of the pilot hole 10A in the metal stock sheet 10. In the gripped state of the peripheral rim 10B of the pilot hole 10A in the metal stock sheet 10 by the flat pad face 26A and the punch face 22B as in the first exemplary embodiment and the second exemplary embodiment, at the end of the second process, there is a possibility that a tiny gap might appear between the pad face 26A and the end 10C of the pilot hole 10A. In such cases, there would be a concern of being unable to grip the end 10C of the pilot hole 10A effectively using the punch 22 and the pad 26. By contrast, forming the pad face 26A with the inclined face 26A1 and gripping the end 10C of the pilot hole 10A in the metal stock sheet 10 with the inclined face 26A1 and the punch face 22B enables the gripped state of the end 10C of the pilot hole 10A in the metal stock sheet 10 by the punch 22 and the pad 26 to be maintained from the first process until the end of the second process. This thereby enables cracking of the leading end portion 14A of the flange 14 to be effectively suppressed. Note that in cases in which this modified example is applied to the second exemplary embodiment, configuration is such that the spacer 52 is fixed to the punch face 22B of the punch 22.

Note that in the first exemplary embodiment and the second exemplary embodiment, the peripheral rim 10B of the pilot hole 10A in the metal stock sheet 10 is pressed by the punch 22 and the pad 26 from the beginning of the second process. Namely, from the perspective of raising the ductility of the metal stock sheet 10 when shaping the flange 14, it is desirable to apply pressure to the metal stock sheet 10 from the beginning of the second process. However, the timing at which pressing of the metal stock sheet 10 by the punch 22 and the pad 26 begins may be delayed. Namely, pressing of the peripheral rim 10B of the pilot hole 10A in the metal stock sheet 10 by the punch 22 and the pad 26 may begin partway through the second process. For example, a gap may be provided between the pad face 26A of the pad 26 and the metal stock sheet 10 at the beginning of the second process. In such cases, in the second process, when the punch 22 is moved toward the device upper side, the peripheral rim 10B of the pilot hole 10A is extruded toward the device upper side together with the punch 22, and the peripheral rim 10B of the pilot hole 10A abuts the pad 26. Accordingly, pressing of the peripheral rim 10B of the pilot hole 10A in the metal stock sheet 10 by the punch 22 and the pad 26 begins partway through the second process. Namely, configuration may be made in which the peripheral rim 10B of the pilot hole 10A is pressed by the punch 22 and the pad 26 at least during a period beginning after a predetermined duration has elapsed from when the punch 22 starts to extrude the metal stock sheet 10 and continuing until the peripheral rim 10B of the pilot hole 10A comes out from between the punch 22 and the pad 26.

Moreover, in the first exemplary embodiment, tests were carried in which this gap was varied. No cracking of the leading end portion 14A of the flange 14 was observed for gaps of from 0 mm to 3 mm. However, cracking was observed at the leading end portion 14A of the flange 14 when the gap was set to 4 mm. Namely, a gap may be provided between the pad face 26A of the pad 26 and the metal stock sheet 10 at the beginning of the second process taking in consideration such issues as the material and sheet thickness of the metal stock sheet 10, and the hole enlargement factor of the flange 14.

Moreover, in the first exemplary embodiment, the external diameter D5 of the pad 26 is the same dimension as the external diameter D4 of the punch face 22B. Alternatively, the external radial direction inner side diameter D5 of the pad 26 may be set to no smaller than the external diameter D4 of the punch face 22B and no greater than the external diameter D3 of the punch 22. Moreover, in the second exemplary embodiment, the external diameter D5 of the pad 26 is the same dimension as the external diameter D3 of the punch 22. Alternatively, in the second exemplary embodiment, the external diameter D5 of the pad 26 may be set to no smaller than the external diameter D4 of the punch face 22B and no greater than the external diameter D3 of the punch 22. Namely, the external diameter D5 of the pad 26 may be modified as appropriate to a degree in which scrap does not occur at the leading end portion 14A of the flange 14. It is desirable for the external diameter D5 of the pad 26 to be no smaller than the external diameter D4 of the punch face 22B and no greater than the external diameter D3 of the punch 22 in both the first exemplary embodiment and the second exemplary embodiment. The external diameter D5 of the pad 26 needs to be no smaller than the external diameter D4 of the punch face 22B in order to press down on the metal stock sheet 10 with the punch 22 and the pad 26 for as long as possible during burring. However, there is no difference in the time for which the metal stock sheet 10 is pressed down between cases in which the external diameter D5 is greater than the external diameter D4, and cases in which the external diameter D5 is equal to the external diameter D4. It is desirable for the external diameter D5 to be no greater than the external diameter D3 in order to avoid interference between the leading end portion 14A of the flange and the pad 26 when removing the burred article 12 from the burring device 20 or the burring device 50.

Figure 10A:
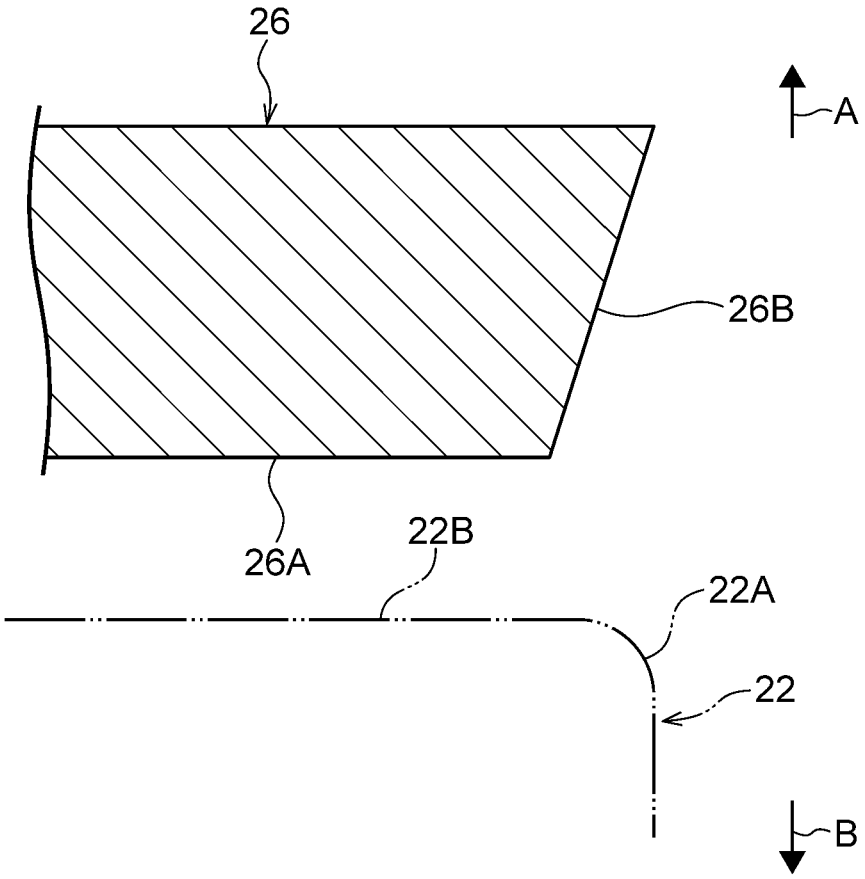
FIG. 10A is a cross-section to explain an example of a case in which an inclined portion is formed to the entirety of an outer peripheral face of a pad.
Figure 10B:
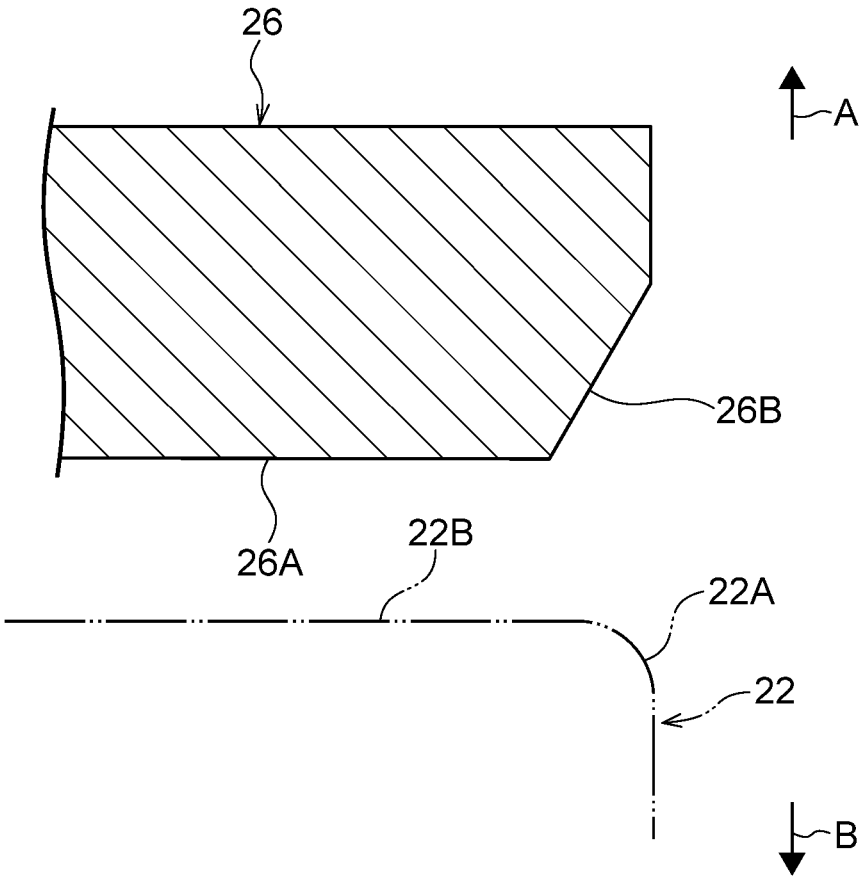
FIG. 10B is a cross-section to explain an example of a case in which an inclined portion is formed to part of an outer peripheral face of a pad.
Figure 10C:
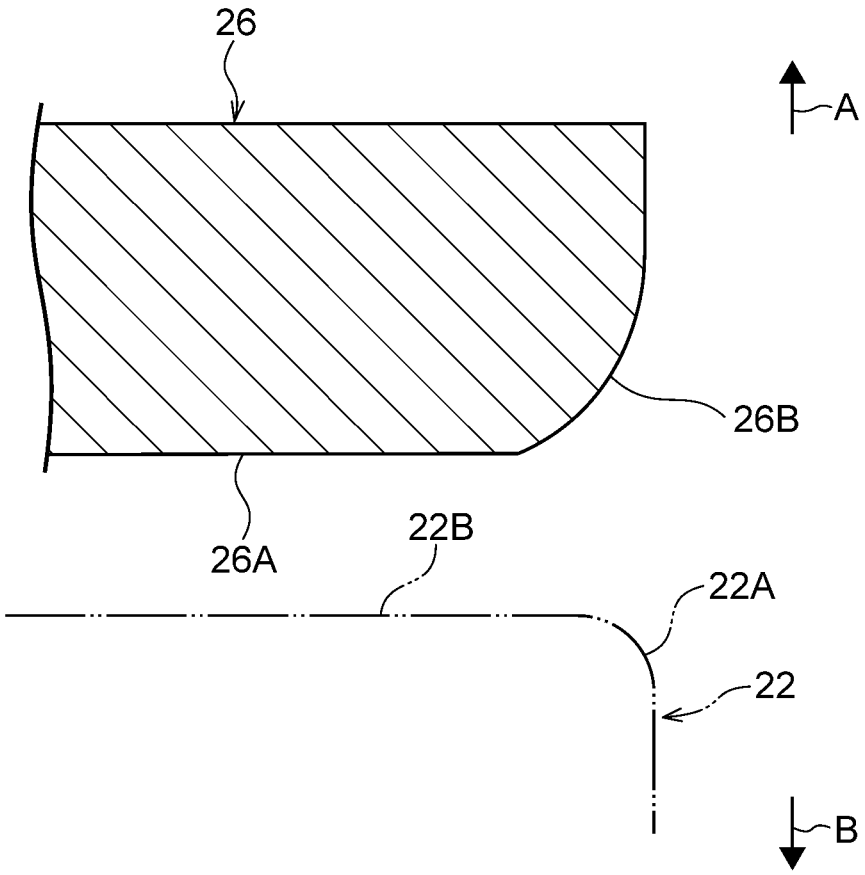
FIG. 10C is a cross-section to explain an example of a case in which a curved inclined portion is formed to part of an outer peripheral face of a pad.

Moreover, in the first exemplary embodiment and the second exemplary embodiment, the outer peripheral edge of the pad face 26A of the pad 26 is formed as a substantially right angle. However, the outer peripheral edge may be formed with an inclined portion, serving as a "reduced diameter portion" where the external diameter of the pad face 26A is reduced. For example, as illustrated in FIG. 10A, the entire outer peripheral face of the pad 26 may be formed with an inclined portion 26B having a linear incline toward the radial direction inner side of the pad 26 on progression toward the punch 22 side as viewed in vertical cross-section. The inclined portion 26B overlaps the shoulder 22A of the punch 22 in the device up-down direction. Moreover, as illustrated in FIG. 10B, part of the outer peripheral face of the pad 26 may be formed with an inclined portion 26B having a linear incline toward the radial direction inner side of the pad 26 on progression toward the punch 22 side as viewed in vertical cross-section. Moreover, as illustrated in FIG. 10C, part of an outer peripheral face of the pad 26 may be formed with an inclined portion 26B having a curved incline toward the radial direction inner side of the pad 26 on progression toward the punch 22 side as viewed in vertical cross-section. This thereby enables the outer peripheral face of the pad 26 to be suppressed from shearing the inner peripheral face of the pilot hole 10A in the metal stock sheet 10 when the pad 26 moves toward the device lower side relative to the punch 22.

Moreover, in the first exemplary embodiment and the second exemplary embodiment, the punch 22 is configured with a flat top face (upper face). However, it is sufficient that at least the periphery of the punch 22 has a flat top face.

Moreover, in the second exemplary embodiment, the spacer 52 is provided on the punch face 22B of the punch 22. However, configuration may be made in which the spacer 52 is provided on the pad face 26A of the pad 26.

Moreover, in the second exemplary embodiment, the spacer 52 has a substantially circular disc shape, and is disposed coaxially to the punch 22. However, the spacer 52 may be configured with a substantially circular ring shape and be disposed coaxially to the punch 22.

Moreover, in the first exemplary embodiment and the second exemplary embodiment, the entire punch 22 is formed in a circular columnar shape. However, the present disclosure is not limited to such a configuration. For example, configuration may be made in which the punch 22 is only formed with a circular columnar shape at a portion on the punch face 22B side. Moreover, in the first exemplary embodiment and the second exemplary embodiment, the entire pad 26 is formed in a circular columnar shape. However, the present disclosure is not limited to such a configuration. For example, configuration may be made in which the pad 26 is only formed with a circular columnar shape at a portion on the pad face 26A side.

Moreover, in the first exemplary embodiment and the second exemplary embodiment, the flange 14 is formed in a cylinder shape on the burred article 12. However, the shape of the flange 14 is not limited thereto. For example, the flange 14 may be formed in a rectangular tube shape. In such cases, the punch 22 is formed in a rectangular column shape. Moreover, the flange 14 may be formed in a cylinder shape provided with a bottom. Specifically, a flange portion may be formed extending from the leading end portion 14A of the flange 14 toward the radial direction inner side of the flange 14. In such cases, the state illustrated in FIG. 2B would correspond to the end of the second process of the burring method.

Moreover, in the first exemplary embodiment and the second exemplary embodiment, explanation has been given regarding an example in which burring is performed on the metal stock sheet 10. However, the workpiece to which a burr is applied is not limited thereto. For example, the burring method of the first exemplary embodiment or the second exemplary embodiment may be applied in a case in which a burr is formed on a press-molded article after pressing. In such cases, the pressed article corresponds to the "workpiece" of the present exemplary embodiments.

The disclosure of Japanese Patent Application No. 2016-009531, filed on Jan. 21, 2016, is incorporated in its entirety by reference herein.

All cited documents, patent applications, and technical standards mentioned in the present specification are incorporated by reference in the present specification to the same extent as if each individual cited document, patent application, or technical standard was specifically and individually indicated to be incorporated by reference.

The following Supplements are also disclosed in relation to the above exemplary embodiments.

Supplement 1

A burring method, including:

a placement process of disposing a sheet-shaped workpiece formed with a through hole such that a punch is positioned on one sheet thickness direction side of the workpiece and a pad is positioned on the opposite side to the one sheet thickness direction side of the workpiece; and an extrusion process of forming a flange by moving the punch toward the opposite side relative to the workpiece and extruding a peripheral rim of the through hole in the workpiece with the punch in a state in which the peripheral rim of the through hole is pressed by the punch and the pad in the sheet thickness direction of the workpiece.

Supplement 2

The burring method of supplement 1, wherein the peripheral rim of the through hole is pressed by the punch and the pad in the sheet thickness direction of the workpiece from the beginning of the extrusion process.

Supplement 3

The burring method of either supplement 1 or supplement 2, wherein in the extrusion process, the punch is moved toward the opposite side relative to the workpiece in a state in which at least an end part of the peripheral rim of the through hole is pressed in the sheet thickness direction of the workpiece.

Supplement 4

The burring method of any one of supplement 1 to supplement 3, wherein:

a spacer is provided at a top face of the punch or at a face of the pad opposing the punch, and the spacer is positioned inside the through hole in the extrusion process; and a thickness of the spacer is thinner than the sheet thickness of the workpiece.

Supplement 5

The burring method of any one of supplement 1 to supplement 4, wherein:

the punch and the pad are formed in circular columnar shapes;

a punch shoulder is connected to an outer peripheral portion of a top face of the punch; and an external diameter of the pad is no smaller than an external diameter of the top face and no greater than an external diameter of the punch.

Supplement 6

The burring method of any one of supplement 1 to supplement 5, wherein:

the pad is formed in a circular columnar shape; and an outer peripheral face of the pad is formed with a reduced diameter portion having a smaller external diameter at a face of the pad opposing the punch.

Supplement 7

The burring method of supplement 6, wherein the reduced diameter portion is configured as an inclined portion inclined toward a radial direction inner side of the pad on progression toward the punch side.

Supplement 8

A burring device, including:

a punch that is disposed on one sheet thickness direction side of a sheet-shaped workpiece formed with a through hole, and that is moved relative to the workpiece toward the opposite side to the one sheet thickness direction side of the workpiece so as to extrude a peripheral rim of the through hole in the workpiece to form a flange; and a pad that is disposed opposing the punch on the opposite side to the one sheet thickness direction of the workpiece, and that, together with the punch, presses the peripheral rim of the through hole in the workpiece during extrusion of the workpiece by the punch.

Supplement 9

The burring device of supplement 8, wherein at least an end part of the peripheral rim of the through hole is pressed by the punch and the pad.

Supplement 10

The burring device of either supplement 8 or supplement 9, wherein:

a spacer is provided at a top face of the punch or at a face of the pad opposing the top face; and a thickness of the spacer is thinner than the sheet thickness of the workpiece.

Supplement 11

The burring device of any one of supplement 8 to supplement 10, wherein:

a top face-side portion of the punch has a circular columnar shape;

an opposing face-side portion of the pad opposing the top face has a circular columnar shape;

a punch shoulder is connected to an outer peripheral portion of the top face of the punch; and an external diameter of the pad is no smaller than an external diameter of the top face and no greater than an external diameter of the punch.

Supplement 12

The burring device of any one of supplement 8 to supplement 11, wherein:

the pad is formed in a circular columnar shape; and an outer peripheral face of the pad is formed with a reduced diameter portion having a smaller external diameter at a face of the pad opposing the punch.

Supplement 13

The burring device of supplement 12, wherein the reduced diameter portion is configured by an inclined portion inclined toward a radial direction inner side of the pad on progression toward the punch side.

Supplement 14

The burring device of any one of supplement 8 to supplement 13, further including:

a holder that is disposed surrounding the punch;

a die that is disposed opposing the holder, that is open toward the punch side, and that includes a housing portion in which the pad is housed;

at least one of a punch mover device that moves the punch or a die mover device that moves the die; and a controller that controls the at least one of the punch mover device or the die mover device, wherein the controller controls the at least one of the punch mover device or the die mover device so as to form a flange by moving the punch toward the opposite side relative to the workpiece and extruding the peripheral rim of the through hole with the punch in a state in which the peripheral rim of the through hole is pressed in the sheet thickness direction of the workpiece, by the punch disposed on the one sheet thickness direction side of the workpiece formed with the through hole and the pad disposed on the opposite side of the workpiece to the one sheet thickness direction side.

Supplement 15

A burring device, including:

a punch that includes a flat top face at least at a periphery of the punch, and that includes a top face-side portion with a circular columnar shape;

a holder that is disposed surrounding the punch;

a die that is disposed opposing the holder, and that includes a housing portion open toward the punch side; and a pad that is disposed inside the housing portion, that is capable of moving in a pressing direction, and that includes an opposing face opposing the top face of the punch.

Supplement 16

The burring device of supplement 15, wherein:

the punch is capable of moving in an axial direction; and the pad has a circular columnar shape, is disposed coaxially to the punch, and is capable of moving in the axial direction, the axial direction being the pressing direction.

Supplement 17

The burring device of either supplement 15 or supplement 16, wherein the pad is capable of moving at least to a position at which the opposing face is aligned with an opening face of the housing portion of the die.

Supplement 18

The burring device of any one of supplement 15 to supplement 17, wherein a spacer is provided at either the top face or the opposing face.

Supplement 19

The burring device of supplement 18, wherein a thickness of the spacer is less than a radial direction clearance between the punch and the die.

Supplement 20

The burring device of either supplement 18 or supplement 19, wherein the spacer is disposed on an axis of the punch.

Supplement 21

The burring device of any one of supplement 15 to supplement 20, wherein a hardened surface layer is formed on the opposing face of the pad.

Supplement 22

The burring device of any one of supplement 15 to supplement 21, wherein:

a beveled punch shoulder is provided at a corner between the top face and a body of the punch; and an external diameter of the pad is no smaller than an external diameter of the top face and no greater than an external diameter of the body.

Supplement 23

The burring device of any one of supplement 15 to supplement 22, wherein a body on the punch side of the pad is provided with an inclined portion having an external diameter that decreases on progression toward the punch side.

Supplement 24

The burring device of supplement 23 when dependent from supplement 22, wherein the punch shoulder and the inclined portion overlap each other in the pressing direction.

Supplement 25

The burring device of any one of supplement 15 to supplement 22, wherein a peripheral outer side of the opposing face of the pad is formed with an inclined face inclined in a direction away from the punch on progression toward the peripheral outer side of the opposing face.

Supplement 26

A burring method for forming a tubular flange on a sheet-shaped workpiece formed with a pilot hole, the burring method including:

an extrusion process of forming the flange by moving a punch disposed on one sheet thickness direction side of the workpiece toward another sheet thickness direction side of the workpiece relative to the workpiece and extruding a peripheral rim of the pilot hole; wherein in the extrusion process, the punch and a pad disposed opposing the punch on the other sheet thickness direction side of the workpiece press the peripheral rim of the pilot hole in the sheet thickness direction of the workpiece.

Supplement 27

A burring device for forming a tubular flange on a sheet-shaped workpiece formed with a pilot hole, the burring device including:

a punch that is disposed on one sheet thickness direction side of the workpiece, and that is moved relative to the workpiece toward another sheet thickness direction side of the workpiece so as to extrude a peripheral rim of the pilot hole in the workpiece and form the flange; and a pad that is disposed opposing the punch on the other sheet thickness direction side of the workpiece, and that, together with the punch, presses a peripheral rim of the pilot hole in the workpiece in an extrusion process performed on the workpiece by the punch.

In the burring method of supplement 26 and the burring device of supplement 27, the punch is disposed on the one sheet thickness direction side of the workpiece, and the pad is disposed on the other sheet thickness direction side of the workpiece, such that the punch and the pad are disposed opposing each other in the sheet thickness direction of the workpiece. Moreover, in the extrusion process, the punch is moved toward the other sheet thickness direction side of the workpiece relative to the workpiece so as to extrude the peripheral rim of the pilot hole in the workpiece and form the flange to the workpiece.

Note that in the extrusion process, the peripheral rim of the pilot hole in the workpiece is pressed in the sheet thickness direction of the workpiece by the punch and the pad. In other words, in the extrusion process, the flange is formed while compressing the peripheral rim of the pilot hole in the workpiece in the sheet thickness direction of the workpiece. This thereby enables cracking of a leading end portion of the flange to be suppressed. Namely, is known that the ductility of a material increases when under hydrostatic pressure in which compression force is applied from the surroundings of the material. The peripheral rim of the pilot hole can thus be placed under pseudo-hydrostatic pressure when shaping the flange with the punch due to compressing the peripheral rim of the pilot hole in the workpiece in the sheet thickness direction as described above. The ductility of the peripheral rim is thus higher than in cases in which the peripheral rim is not pressed. Accordingly, when shaping the flange, the flange is formed in a state in which the peripheral rim of the pilot hole has heightened ductility, thereby enabling cracking of the leading end portion of the flange to be suppressed. In this manner, the burring method of supplement 26 and the burring device of supplement 27 enable cracking of the leading end portion of the flange to be suppressed without setting the shape of the punch to a shape adapted to the pilot hole in the workpiece. Note that in the burring method and the burring device of the present disclosure, "under hydrostatic pressure" refers to any state in which compression force is applied to the material from its surroundings under atmospheric pressure, without submerging the material in water.

Supplement 28

A burring device including:

a column shaped punch that is configured including a flat top face and a punch shoulder connected to an outer peripheral portion of the top face;

a holder that is disposed at an outer peripheral side of the punch;

a die that is disposed opposing the punch and the holder, and that includes a housing portion opening toward the punch side; and a pad that is provided capable of moving within the housing portion in the direction in which the pad opposes the punch, and that includes an opposing face disposed opposing the top face of the punch.

The invention claimed is:

1. A burring method, comprising: disposing a sheet-shaped workpiece formed with a through hole such that a punch is positioned on one sheet thickness direction side of the workpiece and a pad is positioned on the opposite side to the one sheet thickness direction side of the workpiece; and forming a flange by moving the punch toward the opposite side relative to the workpiece and extruding a peripheral rim of the through hole in the workpiece with the punch in a state in which the peripheral rim of the through hole is pressed by the punch and the pad in the sheet thickness direction of the workpiece; wherein a spacer is provided at a top face of the punch or at a face of the pad opposing the punch, and the spacer is positioned inside the through hole in the forming of the flange; and a thickness of the spacer is thinner than the sheet thickness of the workpiece.

2. The burring method of claim 1, wherein:

the punch and the pad are formed in circular columnar shapes;

a punch shoulder is connected to an outer peripheral portion of a top face of the punch; and an external diameter of the pad is no smaller than an external diameter of the top face and no greater than an external diameter of the punch.

* * * * *